US007524036B2

(12) United States Patent
Mataki

(10) Patent No.: US 7,524,036 B2
(45) Date of Patent: Apr. 28, 2009

(54) LIQUID EJECTION HEAD AND LIQUID EJECTION APPARATUS

(75) Inventor: Hiroshi Mataki, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 448 days.

(21) Appl. No.: 11/218,463

(22) Filed: Sep. 6, 2005

(65) Prior Publication Data

US 2006/0050111 A1 Mar. 9, 2006

(30) Foreign Application Priority Data

Sep. 6, 2004 (JP) ..... 2004-258907

(51) Int. Cl.
*B41J 2/05* (2006.01)
*B41J 2/045* (2006.01)

(52) U.S. Cl. ..... 347/65; 347/68

(58) Field of Classification Search ..... 347/65, 347/68–72

See application file for complete search history.

(56) References Cited

U.S. PATENT DOCUMENTS

| | | | | |
|---|---|---|---|---|
| 4,471,363 | A | 9/1984 | Hanaoka | |
| 5,754,204 | A | 5/1998 | Kitahara | |
| 5,933,168 | A | 8/1999 | Sakai | |
| 6,183,067 | B1 * | 2/2001 | Matta | 347/65 |
| 2002/0008737 | A1 | 1/2002 | Inui et al. | |
| 2002/0027585 | A1 * | 3/2002 | Oda et al. | 347/92 |
| 2002/0175976 | A1 * | 11/2002 | Okuda | 347/71 |

FOREIGN PATENT DOCUMENTS

| | | | |
|---|---|---|---|
| JP | 57-59774 | A | 4/1982 |
| JP | 5-116320 | A | 5/1993 |
| JP | 8-290571 | A | 11/1996 |
| JP | 9-14851 | A | 6/1997 |
| JP | 09-141851 | A | 6/1997 |
| JP | 9-327909 | A | 12/1997 |

* cited by examiner

*Primary Examiner*—Stephen D Meier
*Assistant Examiner*—Geoffrey Mruk
(74) *Attorney, Agent, or Firm*—Birch, Stewart, Kolasch & Birch, LLP

(57) ABSTRACT

The liquid ejection head having a nozzle through which liquid is ejected, the nozzle having an inertance Mn; a pressure chamber which accommodates the liquid to be ejected through the nozzle; a pressuring device which applies pressure to the liquid accommodated in the pressure chamber by deforming the pressure chamber to eject the ink from the pressure chamber; and a supply side flow passage which communicates with the pressure chamber and supplies the liquid to the pressure chamber, the supply side flow passage having an inertance Ms smaller than the inertance Mn of the nozzle.

9 Claims, 15 Drawing Sheets

LIQUID EJECTION HEAD AND LIQUID EJECTION APPARATUS

BACKGROUND OF THE INVENTION

1. Field of the Invention

The present invention relates to a liquid ejection head and a liquid ejection apparatus, and more particularly to the structure of a liquid ejection head used in an inkjet recording apparatus or the like.

2. Description of the Related Art

As an example of an image forming apparatus, there is known an inkjet recording apparatus which has an inkjet head (ejection head) having disposed multiple nozzles (ejection elements) therein, and forms an image on a medium (ejection receiving medium) by ejecting ink from the nozzles while relatively moving the inkjet head and the medium.

For an ink ejection method in an inkjet head of an inkjet recording apparatus, there is known a piezoelectric method where a diaphragm (pressure plate) constituting a part of a pressure chamber is deformed by deformation of a piezoelectric element to change the volume of the pressure chamber, ink is introduced from an ink supply path into the pressure chamber when the volume of the pressure chamber is increased, and then the ink inside the pressure chamber is ejected as a droplet from a nozzle when the volume of the pressure chamber is reduced, and also a thermal inkjet method where ink in an ink chamber (pressure chamber) is heated to generate bubbles, and then the ink is ejected with the inflation energy generated when the bubbles grow.

In the inkjet recording apparatus, the ink ejection performance affects the quality of the obtained image and the printing efficiency, and therefore the inkjet head has been subjected to various modifications to realize stable, high-speed ink ejection. In the piezoelectric method, for example, there are proposed techniques such as performing a pull ejection using the resonance between the compliance of the pressure chamber part and the inertance of the nozzle part to achieve stable, high-speed ink ejection.

Japanese Patent Application Publication No. 57-59774 discloses a driving method for an on-demand inkjet head, which ejects ink through nozzles using ejection pressure generated by piezoelectric elements, in which the volume of the pressure chamber is decreased by electrically charging the piezoelectric element in advance while the inkjet head is on standby prior to ink ejection. Then, during ink ejection, the piezoelectric element is made gradually discharged to increase the volume of the pressure chamber, whereupon the piezoelectric element is rapidly recharged to decrease the volume of the pressure chamber, and thus ink is ejected through the nozzle.

Japanese Patent Application Publication No. 9-327909 discloses a recording method for an inkjet recording apparatus and a head adapted to this recording method, in which a meniscus resting at a nozzle opening is rapidly drawn in such that a central region of the meniscus is displaced by a relatively large amount to a pressure-generating chamber side. When movement of the central region of the meniscus toward the pressure-generating chamber reverses, the central region of the meniscus, which is near to the pressure-generating chamber side, contracts, producing an inertial flow. The central region alone is thereby pushed out at a high speed such that an ink droplet having a smaller diameter than the diameter of the nozzle opening is ejected with stability and at a suitable speed for printing.

In the above-described related art, however, when the viscosity of the ink increases, vibration attenuation caused by the viscosity increases, and hence resonance in an even higher frequency domain (resonance point) should be used. In order to raise the resonance point, measures such as reducing the size of the pressure chamber, widening the nozzle diameter, and reducing the nozzle length should be taken.

When the size of the pressure chamber is reduced, the size of actuator provided on the pressure chamber also decreases, which may lead to deterioration in the actuator performance. When the nozzle diameter is widened, it becomes difficult to achieve the high nozzle density that is required for high-speed printing. Moreover, the nozzles that are in practical use at present are very short, and if the nozzle length were reduced even further, the rigidity of the ejection surface would decrease, causing a possible deterioration in the ejection stability. Further, when the ink viscosity increases, ink cannot be ejected unless pressure above a certain level is applied, and hence it becomes impossible to eject smaller ink droplets than the ink droplet amount corresponding to this pressure. As a result, the size of the ink droplets ejected cannot be made small.

In the driving method for an on-command inkjet head described in Japanese Patent Application Publication No. 57-59774, a technique is disclosed whereby an electric pulse is modified to enable active use of the damped vibration (resonance) of a vibration system constituted by the pressure chamber wall, an electromechanical transducing element, and the ink. However, when the ink viscosity increases, it may be impossible to maintain a predetermined ejection frequency.

In the recording method for an inkjet recording apparatus and the head adapted to this recording method, described in Japanese Patent Application Publication No. 9-327909, ink droplets having a smaller size than the nozzle diameter are ejected using the resonance phenomenon between the pressure-generating chamber and the ink to concentrate pressure in the central portion of the meniscus; however, there is no disclosure of an increase in the ejection frequency.

SUMMARY OF THE INVENTION

The present invention has been contrived in consideration of these circumstances, and it is an object thereof to provide a liquid ejection head and liquid ejection apparatus which are capable of maintaining a similar ejection frequency to that of low-viscosity liquid even when highly viscous liquid is used, and are therefore capable of ejecting small liquid droplets.

In order to attain the aforementioned object, the present invention is directed to a liquid ejection head, comprising: a nozzle through which liquid is ejected, the nozzle having an inertance Mn; a pressure chamber which accommodates the liquid to be ejected through the nozzle; a pressurizing device which applies pressure to the liquid accommodated in the pressure chamber by deforming the pressure chamber to eject the ink from the pressure chamber; and a supply side flow passage which communicates with the pressure chamber and supplies the liquid to the pressure chamber, the supply side flow passage having an inertance Ms smaller than the inertance Mn of the nozzle.

In other words, the relationship between the inertance Mn of the nozzle and the inertance Ms of the supply side flow passage satisfies Mn>Ms, and the resonance frequency between the compliance of the pressure chamber and the inertance of the nozzle and supply side flow passage can be increased. Therefore, liquid ejection can be performed using the resonance between the compliance of the pressure chamber and the inertance of the nozzle even when highly viscous ink, with which the resonance between the compliance of the pressure chamber and the inertance of the nozzle attenuates rapidly, is used.

Further, by making the inertance Ms of the supply side flow passage smaller than the inertance Mn of the nozzle, the time required for refilling can be shortened, which leads to a speed increase in the ejection cycle.

Moreover, minute amounts of liquid can be ejected even when the force applied to the liquid from the pressurizing device is increased, and therefore the flying speed of the droplet can be increased.

The term "nozzle" may indicate the opening portion from which the liquid is ejected, and may also include the liquid flow passage (conduit) which connects the opening portion to the pressure chamber. Moreover, the liquid flow passage may be constituted by a plurality of flow passages.

The term "supply side flow passage" denotes a liquid flow passage extending from a liquid storage unit constituted by a liquid tank or the like to the pressure chamber. After liquid is ejected from the nozzle, the liquid stored in the liquid storage unit is supplied to the pressure chamber through the supply side flow passage.

The supply side flow passage may include a common flow passage (main flow) through which liquid flows to a plurality of pressure chambers, each of individual flow passages (branch flow) through which liquid flows to each individual pressure chamber, and so on.

The sectional form of the supply side flow passage may be substantially circular, substantially elliptical, or polygonal forms such as a triangle or square.

When the nozzle and the supply side flow passage are constituted by a plurality of flow passages, the inertance Mn of the nozzle and the inertance Ms of the supply side flow passage are combined inertance of the plurality of flow passages.

A full line head having a nozzle array in which a plurality of ink ejection nozzles are arranged over a length corresponding to the entire width of the ejection receiving medium may be used as a constitutional example of the ejection head.

In this case, a mode may be adopted in which a plurality of relatively short ejection head blocks having nozzles rows which do not reach a length corresponding to the full width of the ejection receiving medium are combined and joined together, thereby forming nozzle rows of a length that correspond to the full width of the ejection receiving medium.

A full line type head is usually disposed in a direction perpendicular to the relative feed direction (relative conveyance direction) of the ejection receiving medium, but modes may also be adopted in which the inkjet head is disposed following an oblique direction that forms a prescribed angle with respect to the direction perpendicular to the relative conveyance direction.

The term "ejection head" may include an inkjet head used in an image forming apparatus such as an inkjet recording apparatus, and any other apparatus referred to as a print head or the like.

An electromechanical transducing element for converting an electric signal into pressure may be used as the pressurizing device, and an actuator which generates displacement in accordance with a drive signal is an example of this electromechanical transducing element. The actuator includes an electrostriction element which generates distortion in accordance with a drive signal, and a diaphragm which is displaced by the distortion of the electrostriction element.

Preferably, a minimum sectional area An of the nozzle and a minimum sectional area As of the supply side flow passage have a relationship of An<As.

Typically, the inertance of the liquid flow passage is inversely proportional to the sectional area of the liquid flow passage. By having the minimum sectional area An of the nozzle and the minimum sectional area As of the supply side flow passage satisfy a relationship of An<As, a structure in which the inertance Ms of the supply side flow passage is smaller than the inertance Mn of the nozzle can be realized.

Of the liquid flow passage (conduit) provided in the nozzle, the part having the smallest sectional area functions as an ejection side restrictor, while the part of the supply side flow passage having the smallest sectional area functions as a supply side. The sectional area of the liquid flow passage provided in the nozzle and the supply side flow passage may be uniform.

The inertance Mn of the nozzle and the inertance Ms of the supply side flow passage are calculated for the flow passages that extend from the parts that are joined to the pressure chamber to the parts that function as the restrictors, respectively. When the nozzle and the supply side flow passage are constituted by a plurality of flow passages, the inertance Mn of the nozzle and the inertance Ms of the supply side flow passage are determined as respective combined inertance of the plurality of flow passages constituting the nozzle and the supply side flow passage.

Preferably, a sectional area A of the supply side flow passage at a joint face with the pressure chamber and the minimum sectional area As of the supply side flow passage have a relationship of A>As.

The joint face which joins the pressure chamber to the supply side flow passage is formed with a supply port at the part of the supply side flow passage having the smallest sectional area. This supply port functions as the restrictor of the supply side flow passage.

Alternatively, it is also preferable that a sectional area A of the supply side flow passage at a joint face with the pressure chamber and the minimum sectional area As of the supply side flow passage have a relationship of A=As. In other words, the wall face joined to the supply side flow passage is eliminated from the pressure chamber, and thereby the supply side flow passage is joined directly to the pressure chamber.

Typically, the inertance Ms of the supply side flow passage is proportional to the flow passage length Ls of the supply side flow passage (i.e., the length of the supply port), and hence the supply side inertance Ms can be reduced by shortening the flow passage length Ls of the supply side flow passage. Accordingly, when the pressure chamber is connected directly to the supply side flow passage, the flow passage length Ls of the supply side flow passage equals zero, and thus the inertance Ms of the supply side flow passage can be reduced to a minimum.

Preferably, the liquid ejection head further comprises a restricting device which varies the minimum sectional area of the supply side flow passage so that the minimum sectional area As of the supply side flow passage when the liquid is supplied from the supply side flow passage into the pressure chamber and the minimum sectional area As' of the supply side flow passage when the liquid is drained into the supply side flow passage from the pressure chamber have a relationship of As<As'.

The flow passage sectional area serving as the minimum sectional area of the supply side flow passage can be varied during liquid supply to the pressure chamber and liquid drainage from the pressure chamber, and therefore the inertance Ms of the supply side flow passage when liquid is drained into the supply side flow passage from the pressure chamber can be reduced even further.

Moreover, by setting the minimum sectional area of the supply side flow passage during refilling, in which liquid is supplied from the supply side flow passage to the pressure chamber, to As, which has a relationship of As<As' in relation to the minimum sectional area As' of the supply side flow passage during a drainage operation for draining liquid into the supply side flow passage from the pressure chamber, air bubbles and foreign matter can be prevented from becoming mixed into the pressure chamber during refilling.

Preferably, the restricting device comprises an elastic member including an opening portion having an opening area smaller than the minimum sectional area As of the supply side flow passage.

The elastic member is displaced such that the opening portion of the elastic member is widened during ejection, while the opening portion is returned to its original size during refilling. As a result, the sectional area of the supply side flow passage can be kept large during ejection, and reduced during refilling.

The opening portion provided in the elastic member is constituted by a hole, a slit, or similar, and may be formed as a circle, a polygon such as a square, or in various other shapes. A material such as rubber or silicone may be used for the elastic member.

Preferably, the pressurizing device comprises a piezoelectric element. By using a piezoelectric element as the pressurizing device, favorable liquid ejection can be realized. A ceramic piezoelectric body such as lead zirconate titanate (Pb(Zr, Ti)O3), known as PZT, or barium titanate (BaTiO3), or a fluoride resin-type piezoelectric body such as polyvinylidene fluoride, known as PVDF, may be used as the piezoelectric element.

Further, a laminated piezoelectric element formed by laminating a plurality of piezoelectric body layers may be applied to the piezoelectric element.

In order to attain the aforementioned object, the present invention is also directed to a liquid ejection apparatus, comprising: an ejection head which ejects droplets of liquid onto an ejection receiving medium, wherein the ejection head includes the above-described liquid ejection head.

Examples of the liquid that is ejected from the ejection head include ink used in an inkjet recording apparatus, or a liquid such as processing liquid, a chemical solution, or water that is deposited onto a medium by a coating apparatus or the like such as a dispenser.

According to the present invention, a nozzle and a supply side flow passage are constituted such that the inertance Mn of the nozzle and the inertance Ms of the supply side flow passage satisfy a relationship of Mn>Ms, and the resonance between the compliance of the pressure chamber and the inertance of the supply side flow passage is used to control liquid ejection. In so doing, the resonance frequency can be increased, and favorable liquid ejection can be realized even when using a highly viscous liquid, with which this resonance attenuates rapidly.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
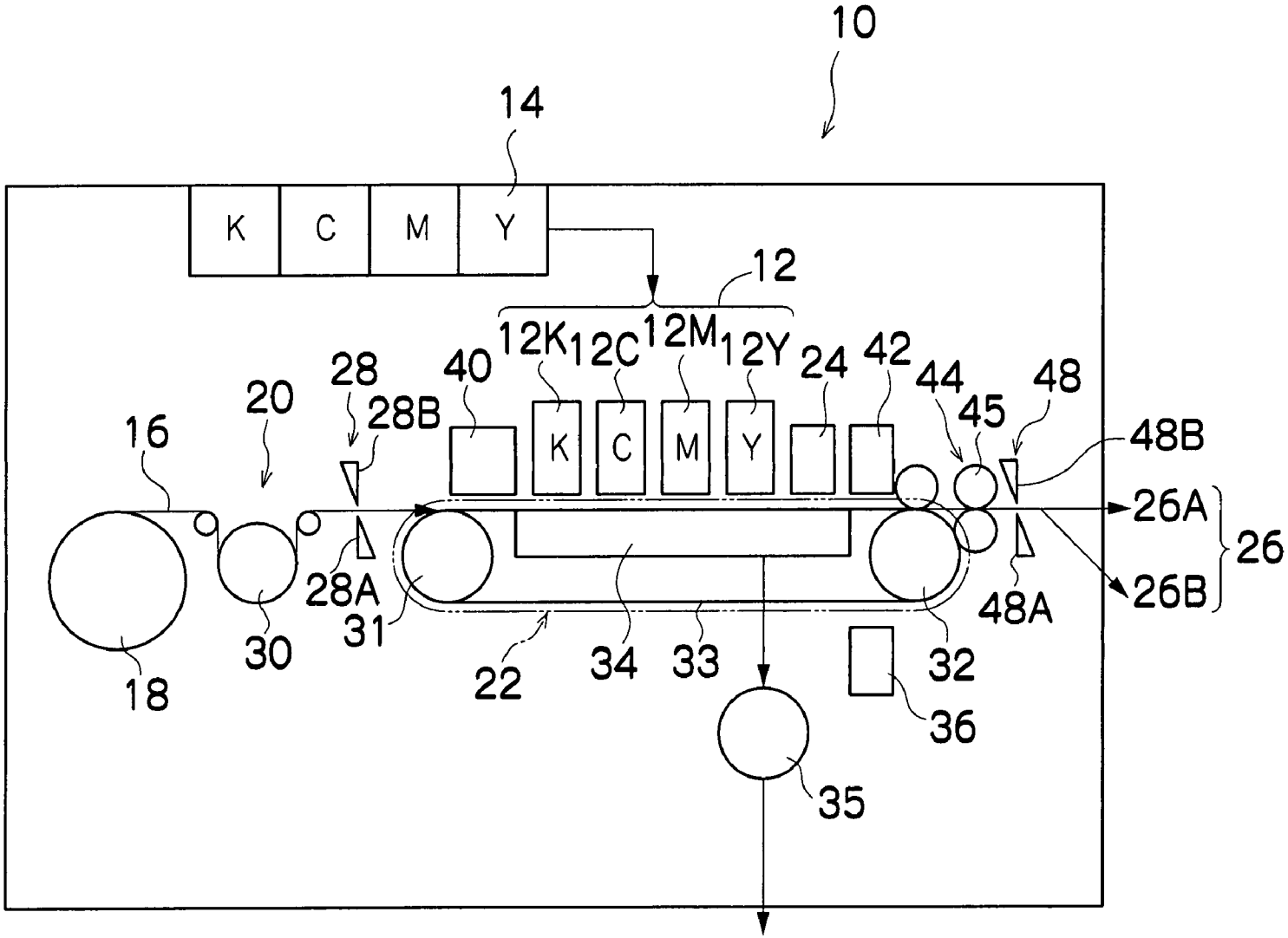
FIG. 1 is an entire configuration diagram of an inkjet recording apparatus according to an embodiment of the present invention.

FIG. 1 is a diagram of the general composition of an inkjet recording apparatus according to an embodiment of the present invention. As shown in FIG. 1, the inkjet recording apparatus 10 comprises: a printing unit 12 having a plurality of inkjet heads 12K, 12C, 12M and 12Y provided for ink colors of black (K), cyan (C), magenta (M) and yellow (Y), respectively; an ink storing and loading unit 14 for storing inks of K, C, M and Y to be supplied to the print heads 12K, 12C, 12M and 12Y; a paper supply unit 18 for supplying recording paper 16; a decurling unit 20 removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 is held on the belt 33 by suction.

The belt 33 is driven in the clockwise direction in FIG. 1 by the motive force of a motor 88 (not shown in FIG. 1, but shown in FIG. 7) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there might be a problem in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
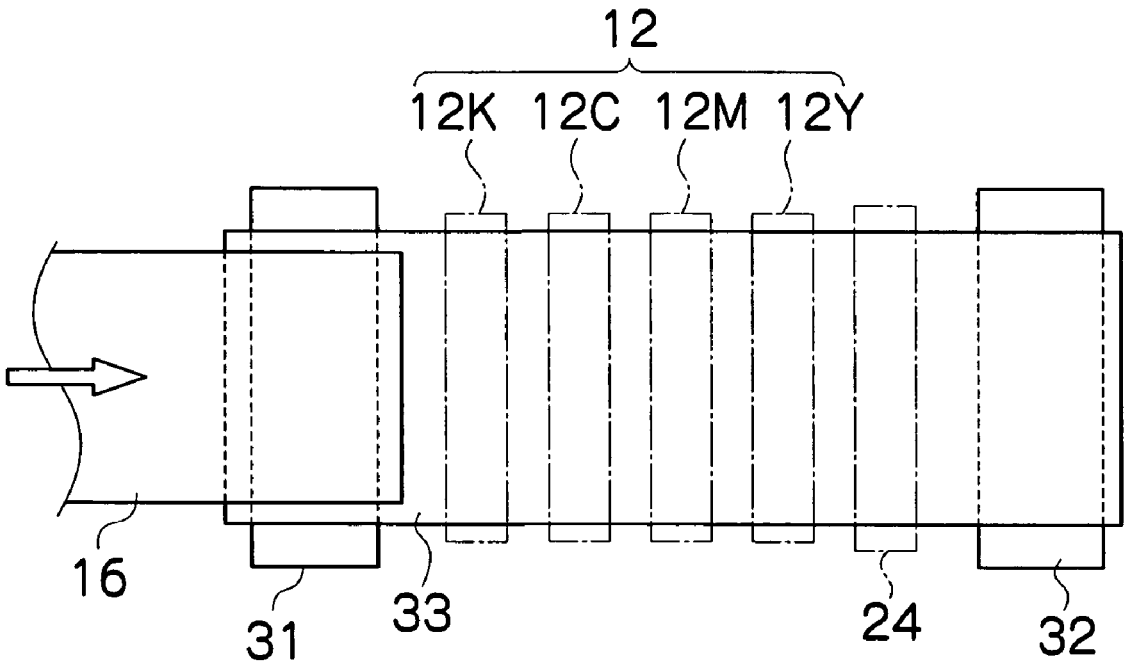
FIG. 2 is a plan view of a principal component around a print unit of the inkjet recording apparatus shown in FIG. 1.

The print unit 12 is a so-called "full line head" in which a line head having a length corresponding to the maximum paper width is arranged in a direction (main scanning direction) that is perpendicular to the conveyance direction of the recording paper (sub-scanning direction) (see FIG. 2). An example of the detailed structure is described below with reference to FIGS. 3A to 5, and each of the print heads 12K, 12C, 12M, and 12Y is constituted by a line head, in which a plurality of ink ejection ports (nozzles) are arranged along a length that exceeds at least one side of the maximum-size recording paper 16 intended for use in the inkjet recording apparatus 10, as shown in FIG. 2.

The print heads 12K, 12C, 12M, and 12Y are arranged in the order of black (K), cyan (C), magenta (M), and yellow (Y) from the upstream side, following the feed direction of the recording paper 16 (hereinafter, referred to as the sub-scanning direction). A color print can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width (the entire width of the printable region) of the paper are thus provided for the respective ink colors, can record an image over the entire surface of the recording paper 16 by performing the action of moving the recording paper 16 and the print unit 12 relatively to each other in the sub-scanning direction just once (in other words, by means of a single sub-scan). Higher-speed printing is thereby made possible and productivity can be improved in comparison with a shuttle type head configuration in which a print head moves reciprocally in the main scanning direction.

Although a configuration with four standard colors, K, M, C and Y, is described in the present embodiment, the combinations of the ink colors and the number of colors are not limited to these, and light and/or dark inks can be added as required. For example, a configuration is possible in which print heads for ejecting light-colored inks such as light cyan and light magenta are added.

As shown in FIG. 1, the ink storing and loading unit 14 has tanks for storing inks of the colors corresponding to the respective print heads 12K, 12C, 12M and 12Y, and each tank is connected to a respective print head 12K, 12C, 12M or 12Y, via a tube channel (not illustrated). The ink storing and loading unit 14 also comprises a warning device (for example, a display device or an alarm sound generator) for warning when the remaining amount of any ink is low, and has a mechanism for preventing loading errors among the colors.

The print determination unit 24 shown in FIG. 1 has an image sensor for capturing an image of the ink-droplet deposition result of the printing unit 12, and functions as a device to check for ejection defects such as clogs of the nozzles in the printing unit 12 from the ink-droplet deposition results evaluated through the image sensor.

The print determination unit 24 of the present embodiment is configured with at least a line sensor having rows of photoelectric transducing elements with a width that is greater than the ink-droplet ejection width (image recording width) of the heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

A test pattern or the target image printed by the print heads 12K, 12C, 12M, and 12Y of the respective colors is read in by the print determination unit 24, and the ejection performed by each head is determined. The ejection determination includes detection of the ejection, measurement of the dot size, and measurement of the dot formation position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Structure of the Head

Next, the structure of a print head will be described. The print heads 12K, 12C, 12M and 12Y provided for the respective ink colors have the same structure, and a reference numeral 50 is hereinafter designated to any of the print heads 12K, 12C, 12M and 12Y.

Figure 3A:
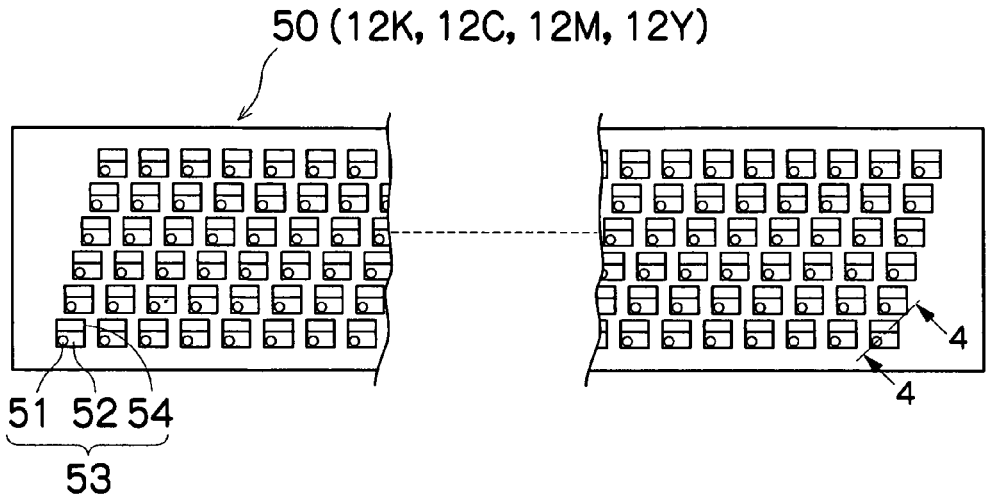
FIGS. 3A to 3C are plan perspective views showing a head of the inkjet recording apparatus shown in FIG. 1.
Figure 3B:
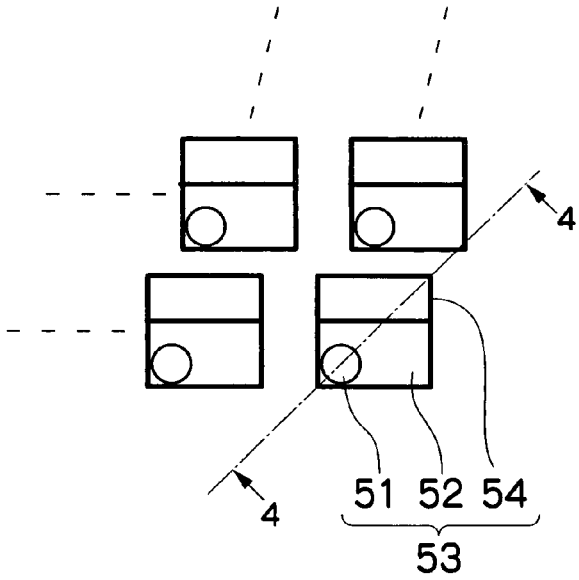
Figure 3C:
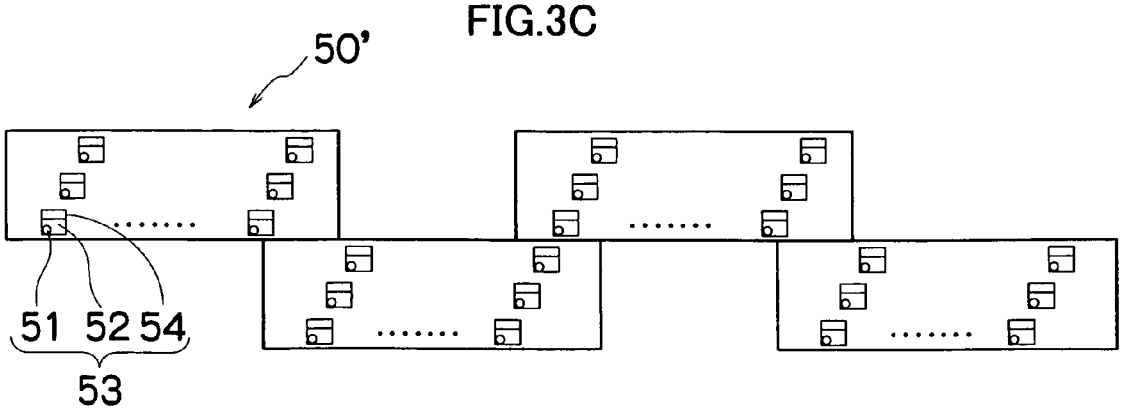
Figure 4:
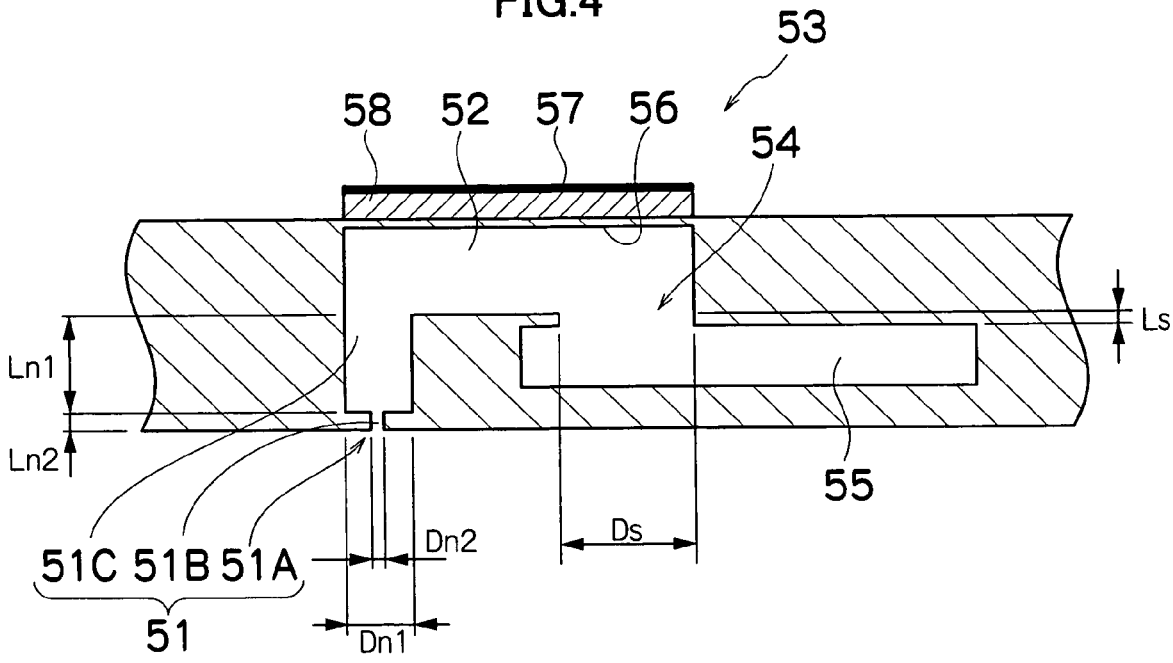
FIG. 4 is a sectional drawing showing an inner structure of the head shown in FIGS. 3A to 3C.

FIG. 3A is a plan view perspective diagram showing an example of the structure of a print head 50, and FIG. 3B is an enlarged diagram of a portion of same. Furthermore, FIG. 3C is a plan view perspective diagram showing a further example of the composition of a print head 50, and FIG. 4 is a cross-sectional diagram showing a three-dimensional composition of an ink chamber unit (being a cross-sectional view along line 4-4 in FIG. 3A). In order to achieve a high density of the dot pitch printed onto the surface of the recording medium, it is necessary to achieve a high density of the nozzle pitch in the print head 50. As shown in FIGS. 3A to 3C and FIG. 4, the print head 50 in the present embodiment has a structure in which a plurality of ink chamber units 53 (ejection elements), each comprising nozzles 51 for ejecting ink droplets and pressure chambers 52 corresponding to the nozzles 51, are disposed in the form of a staggered matrix, and the effective nozzle pitch is thereby made small.

More specifically, as shown in FIGS. 3A and 3B, the print head 50 according to the present embodiment is a full-line head having one or more nozzle rows in which a plurality of nozzles 51 for ejecting ink are arranged along a length corresponding to the entire width of the recording medium in a direction substantially perpendicular to the conveyance direction of the recording medium.

Moreover, as shown in FIG. 3C, it is also possible to use respective heads 50' of nozzles arranged to a short length in a two-dimensional fashion, and to combine same in a zigzag arrangement, whereby a length corresponding to the full width of the print medium is achieved.

The pressure chamber 52 provided corresponding to each of the nozzles 51 has a substantially square planar form, and the nozzle 51 is provided at one of the corner portions on the bottom face thereof. A supply port 54 having a substantially identical width to the pressure chamber 52 and positioned above a common flow passage (liquid supply passage) 55 is provided on the side of the pressure chamber 52 that includes the corner portion diagonally opposite to the corner portion in which the nozzle 51 is provided. Each pressure chamber 52 communicates with the common flow passage 55 via its supply port 54.

The planar form of the pressure chamber 52 is not limited to a substantially square shape, and it is possible to take the form of a rectangle, a rhombus, a parallelogram, a non-quadrilateral polygon, a circle, an ellipse, and so on, for example.

An actuator (pressuring device) 58 provided with an individual electrode 57 is bonded to a pressure plate 56 (a diaphragm that also serves as a common electrode), which forms the ceiling of the pressure chamber 52. When a drive voltage is applied to the individual electrode 57, the actuator 58 is deformed, the volume of the pressure chamber 52 is thereby changed, and the pressure in the pressure chamber 52 is thereby changed, so that the ink inside the pressure chamber 52 is thus ejected through the nozzle 51. The actuator 58 is preferably a piezoelectric element. When ink is ejected, new ink is supplied to the pressure chamber 52 from the common flow channel 55 through the supply port 54.

As shown in FIG. 4, the nozzle 51 in the present embodiment comprises a nozzle narrow-conduit portion 51B positioned in the vicinity of a nozzle opening portion 51A and having a pipe with the same diameter as the nozzle opening portion 51A, and a nozzle broad-conduit portion 51C positioned between the nozzle narrow-conduit portion 51B and the pressure chamber 52 and having a larger pipe diameter than the nozzle narrow-conduit portion 51B.

Among the reference numerals shown in FIG. 4, $L_{n1}$ represents the flow passage length of the nozzle broad-conduit portion 51C, $L_{n2}$ represents the flow passage length of the nozzle narrow-conduit portion 51B, and $L_s$ represents the flow passage length of the supply port 54. Moreover, $D_{n1}$ represents the diameter of the nozzle broad-conduit portion 5C, $D_{n2}$ represents the diameter of the nozzle narrow-conduit portion 51B, and $D_s$ represents the length of one side of the supply port 54 in the width direction. When the supply port 54 has a circular cross-section in the plane orthogonal to the ink flow direction, $D_s$ represents the diameter of the supply port 54.

As will be described in detail hereafter, the ink chamber unit 53 is structured such that a sectional area $A_s$ of the supply port 54 (shown with the hatching in FIG. 9; the sectional area here refers to the sectional area on the substantially orthogonal plane to the ink flow direction) is greater than a sectional area $A_n$ of the nozzle 51 (the sectional area of the nozzle opening portion 51A, the sectional area $A_{n2}$ of the nozzle narrow-conduit portion 51B, or the sectional area $A_{n1}$ of the nozzle broad-conduit portion 51C; the sectional area here refers to the sectional area on the substantially orthogonal plane to the ink flow direction). In other words, the structure of the ink chamber unit 53 satisfies a relationship of $A_n<A_s$. In the aspect shown in FIG. 4, the sectional area $A_s$ of the supply port 54 is substantially half the surface area of the bottom face of the pressure chamber 52.

In other words, the ink chamber unit 53 is structured such that an inertance $M_n$ of the nozzle 51 and an inertance $M_s$ of the supply port 54 satisfies a relationship of $M_n>M_s$. By means of this structure, a predetermined ejection frequency can be maintained even when ink with a higher viscosity than typical ink is used, and hence stable ink droplet ejection can be achieved.

The nozzle narrow-conduit portion 51B has an even thickness (diameter) in FIG. 4; however, it is possible that the nozzle narrow-conduit portion 51B has a tapered structure where the diameter of the nozzle narrow-conduit portion 51B is reduced at a constant rate from the pressure chamber 52 side towards the opening portion 51A side. Moreover, the thicknesses of the nozzle narrow-conduit portion 51B and the nozzle broad-conduit portion 51C may be the same. Furthermore, there may also be provided another conduit portion having a diameter different from the diameters of the nozzle narrow-conduit portion 51B and the nozzle broad-conduit portion 51C.

In the present description, the opening portion 51A or the narrow-conduit portion 51B is occasionally referred to simply as the nozzle 51. Also, the entire flow passage from the nozzle opening portion 51A to the pressure chamber 52, including the passage from the nozzle opening portion 51A through the broad-conduit portion 51C, is also occasionally referred to as the nozzle 51.

In this example, the supply port 54 is not merely an opening portion provided at the interface between the pressure chamber 52 and the supply side, but also the part at which the sectional area of the supply side flow passage is smallest. This part at which the sectional area of the supply side flow passage is smallest includes an ink supply side flow passage (pipe) that functions as a supply side restrictor. The supply side flow passage will be described in detail hereafter.

More specifically, the nozzle 51 and the supply port 54 represent flow paths such as an opening portion, conduit, channel or the like functioning as restrictors, which regulate the flowing amount of the liquid, on the ejection side and supply side, and liquid resistance and inertance are calculated in accordance with the flow paths. The flow path with the restriction function may be configured to have a plurality of flow paths, or may be a part of one flow path.

Figure 5:
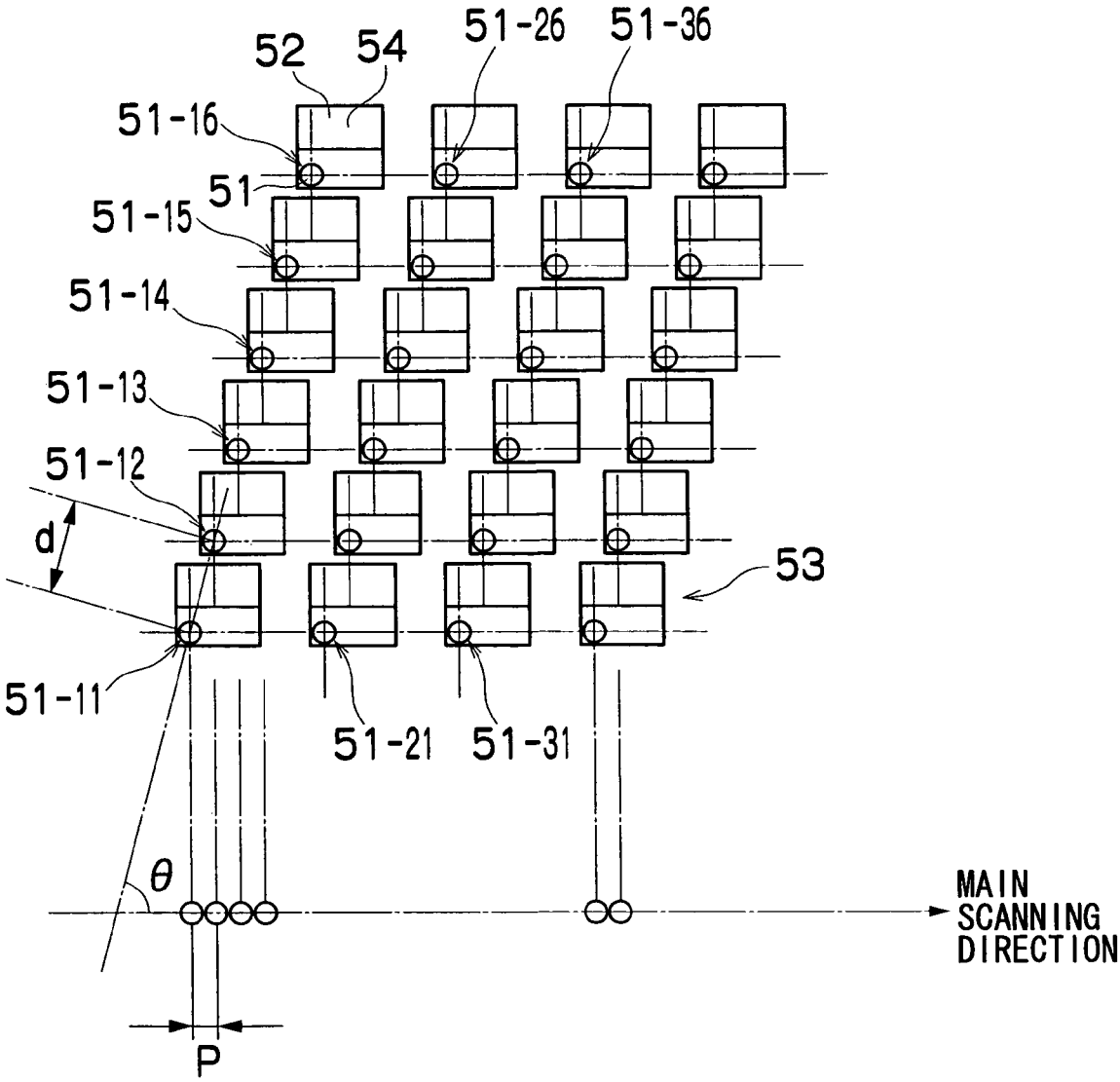
FIG. 5 is an enlarged drawing showing an arrangement of nozzles of the head shown in FIGS. 3A to 3C.

As shown in FIG. 5, the plurality of ink chamber units 53 having this structure are composed in a lattice arrangement, based on a fixed arrangement pattern having a row direction which coincides with the main scanning direction, and a column direction which, rather than being perpendicular to the main scanning direction, is inclined at a fixed angle of θ with respect to the main scanning direction. By adopting a structure wherein a plurality of ink chamber units 53 are arranged at a uniform pitch d in a direction having an angle θ with respect to the main scanning direction, the pitch P of the nozzles when projected to an alignment in the main scanning direction will be d×cos θ.

More specifically, the arrangement can be treated equivalently to one wherein the respective nozzles 51 are arranged in a linear fashion at uniform pitch P, in the main scanning direction. By means of this composition, it is possible to achieve a nozzle composition of high density, wherein the nozzle columns projected to an alignment in the main scanning direction reach a total of 2400 per inch (2400 nozzles per inch). Below, in order to facilitate the description, it is supposed that the nozzles 51 are arranged in a linear fashion at a uniform pitch (P), in the longitudinal direction of the head (main scanning direction).

In a full-line head comprising rows of nozzles corresponding to the entire width of the image recordable width, the "main scanning" is defined as printing a line formed of a row of dots, or a line formed of a plurality of rows of dots in the breadthways direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block; . . . ); and one line is printed in the width direction of the recording paper 16 by sequentially driving the nozzles 51-11, 51-12, . . . , 51-16 in accordance with the conveyance velocity of the recording paper 16.

On the other hand, "sub-scanning" is defined as to repeatedly perform printing of a line formed of a row of dots, or a line formed of a plurality of rows of dots, formed by the main scanning, while moving the full-line head and the recording paper relatively to each other.

The arrangement of the nozzles is not limited to the illustrated examples in the embodiments of the present invention, thus an arrangement in which the nozzles are lined up in a column direction along the main scanning direction and a row direction along the sub-scanning direction, and other various nozzle arrangements can be applied.

Further, in the present embodiment, a single-layer piezoelectric element having one piezoelectric body layer is exemplified; however, the present invention can also be applied to a multilayer piezoelectric element in which two or more piezoelectric body layers are stacked.

The pressure plate 56 also serves as the common electrode in the present embodiment; however, it is possible that the pressure plate 56 and the common electrode are provided separately, and an insulating layer is provided between the pressure plate 56 and the common electrode when using a conducting material, such as a metallic material, for the pressure plate 56.

Configuration of Ink Supply System

Figure 6:
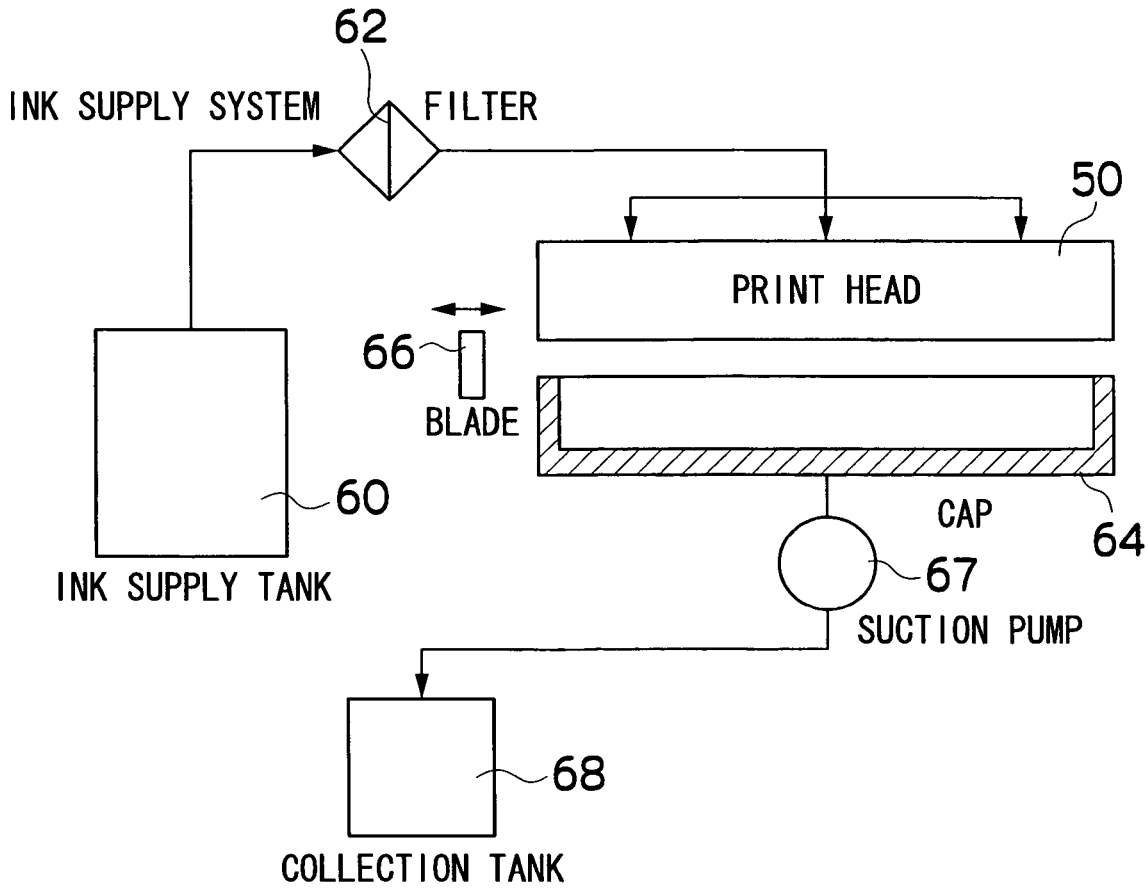
FIG. 6 is a schematic drawing showing a configuration of an ink supply system in the inkjet recording apparatus.

FIG. 6 is a schematic drawing showing the configuration of the ink supply system in the inkjet recording apparatus 10.

The ink tank 60 is a base tank that supplies ink to the head 50 and is set in the ink storing and loading unit 14 described with reference to FIG. 1. The aspects of the ink tank 60 include a refillable type and a cartridge type: when the remaining ink amount is low, the ink tank 60 of the refillable type is filled with ink through a filling port (not shown) and the ink is tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink tank 60 in FIG. 6 is equivalent to the ink storing and loading unit 14 in FIG. 1 described above.

A filter 62 for removing foreign matters and bubbles is disposed between the ink tank 60 and the head 50 as shown in FIG. 6. The filter mesh size in the filter 62 is preferably equivalent to or less than the diameter of the nozzle and commonly about 20 μm. Although not shown in FIG. 6, it is preferable to provide a sub-tank integrally to the print head 50 or nearby the head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face. A maintenance unit including the cap 64 and the cleaning blade 66 can be relatively moved with respect to the head 50 by a movement mechanism (not shown), and is moved from a predetermined holding position to a maintenance position below the head 50 as required.

The cap 64 is displaced up and down relatively with respect to the head 50 by an elevator mechanism (not shown). When the power of the inkjet recording apparatus 10 is turned OFF or when in a print standby state, the cap 64 is raised to a predetermined elevated position so as to come into close contact with the head 50, and the nozzle face is thereby covered with the cap 64.

The cleaning blade 66 is composed of rubber or another elastic member, and can slide on the ink ejection surface (surface of the nozzle plate) of the head 50 by means of a blade movement mechanism (not shown). When ink droplets or foreign matter has adhered to the nozzle plate, the surface of the nozzle plate is wiped and cleaned by sliding the cleaning blade 66 on the nozzle plate.

During printing or standby, when the frequency of use of specific nozzles is reduced and ink viscosity increases in the vicinity of the nozzles, a preliminary discharge is made to eject the degraded ink toward the cap 64.

Also, when bubbles have become intermixed in the ink inside the head 50 (inside the pressure chamber 52), the cap 64 is placed on the head 50, the ink inside the pressure chamber 52 (the ink in which bubbles have become intermixed) is removed by suction with a suction pump 67, and the suction-removed ink is sent to a collection tank 68. This suction action entails the suctioning of degraded ink whose viscosity has increased (hardened) also when initially loaded into the head 50, or when service has started after a long period of being stopped.

When a state in which ink is not ejected from the head 50 continues for a certain amount of time or longer, the ink solvent in the vicinity of the nozzles 51 evaporates and ink viscosity increases. In such a state, ink can no longer be ejected from the nozzle 51 even if the piezoelectric element 58 for the ejection driving is operated. Before reaching such a state (in a viscosity range that allows ejection by the operation of the piezoelectric element 58) the piezoelectric element 58 is operated to perform the preliminary discharge to eject the ink whose viscosity has increased in the vicinity of the nozzle toward the ink receptor. After the nozzle surface is cleaned by a wiper such as the cleaning blade 66 provided as the cleaning device for the nozzle face, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

When bubbles have become intermixed in the nozzle 51 or the pressure chamber 52, or when the ink viscosity inside the nozzle 51 has increased over a certain level, ink can no longer be ejected by the preliminary discharge, and a suctioning action is carried out as follows.

More specifically, when bubbles have become intermixed in the ink inside the nozzle 51 and the pressure chamber 52, ink can no longer be ejected from the nozzle 51 even if the piezoelectric element 58 is operated. Also, when the ink viscosity inside the nozzle 51 has increased over a certain level, ink can no longer be ejected from the nozzle 51 even if the piezoelectric element 58 is operated. In these cases, a suctioning device to remove the ink inside the pressure chamber 52 by suction with a suction pump, or the like, is placed on the nozzle face of the head 50, and the ink in which bubbles have become intermixed or the ink whose viscosity has increased is removed by suction.

However, since this suction action is performed with respect to all the ink in the pressure chambers 52, the amount of ink consumption is considerable. Therefore, a preferred aspect is one in which a preliminary discharge is performed when the increase in the viscosity of the ink is small.

Description of Control System

Figure 7:
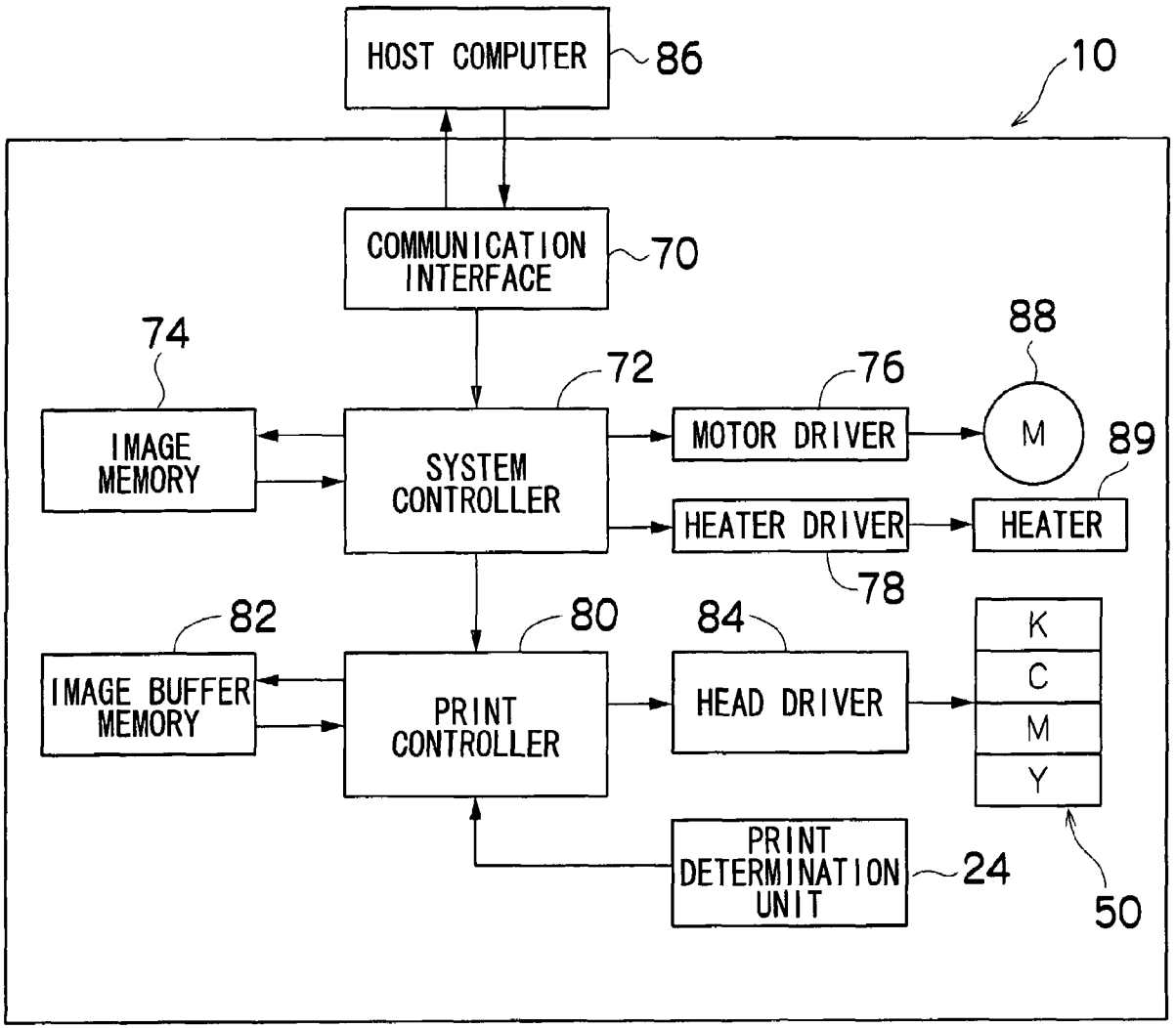
FIG. 7 is a block diagram showing principal components in a system configuration of the inkjet recording apparatus.

FIG. 7 is a principal block diagram showing the system configuration of the inkjet recording apparatus 10. The inkjet recording apparatus 10 comprises a communication interface 70, a system controller 72, an image memory 74, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed.

The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communication interface 70, image memory 74, motor driver 76, heater driver 78, and the like, as well as controlling communications with the host computer 86 and writing and reading to and from the image memory 74, and it also generates control signals for controlling the motor 88 and heater 89 of the conveyance system.

The program executed by the CPU of the system controller 72 and the various types of data which are required for control procedures are stored in the image memory 74. The image memory 74 may be a non-writeable storage device, or it may be a rewriteable storage device, such as an EEPROM. The image memory 74 is used as a temporary storage region for the image data, and it is also used as a program development region and a calculation work region for the CPU.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to supply the generated print data (dot data) to the head driver 84. Prescribed signal processing is carried out in the print controller 80, and the ejection amount and the ejection timing of the ink droplets from the respective print heads 50 are controlled via the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the piezoelectric elements 58 of the heads of the respective colors 12K, 12C, 12M and 12Y on the basis of print data supplied by the print controller 80. The head driver 84 can be provided with a feedback control system for maintaining constant drive conditions for the print heads.

The image data to be printed is externally inputted through the communication interface 70, and is stored in the image memory 74. In this stage, the RGB image data is stored in the image memory 74.

The image data stored in the image memory 74 is sent to the print controller 80 through the system controller 72, and is converted to the dot data for each ink color in the print controller 80. In other words, the print controller 80 performs processing for converting the inputted RGB image data into dot data for four colors, K, C, M and Y. The dot data generated by the print controller 80 is stored in the image buffer memory 82.

Various control programs are stored in a program storage unit (not shown), and the control programs are read and executed in accordance with a command of the system controller 72. For the program storage unit, a semiconductor memory such as a ROM or EEPROM may be used, or a magnetic disk may be used. The program storage unit may have an external interface and use a memory card or a PC card. Of course the program storage unit may have a plurality of storage media of these storage media.

The program storage unit may be used along with a storage device (not shown) for an operation parameter and the like.

The print determination unit 24 is a block that includes the line sensor as described above with reference to FIG. 1, reads the image printed on the recording paper 16, determines the print conditions (presence of the ejection, variation in the dot formation, and the like) by performing desired signal processing, or the like, and provides the determination results of the print conditions to the print controller 80.

According to requirements, the print controller 80 makes various corrections with respect to the head 50 on the basis of information obtained from the print determination unit 24.

In the embodiment shown in FIG. 1, the configuration is such that the print determination unit 24 is provided on the print surface side, and the print surface is illuminated by a light source (not shown) such as a cold-cathode tube disposed in the vicinity of the line sensor, and the reflected light is read by means of the line sensor. However, other configurations may be possible for the embodiments of the present invention.

Detailed Structure of Ink Chamber Unit

Next, the structure of the ink chamber unit 53 shown in FIG. 4 is described in detail.

The print head 50 performs a pull ejection using the resonance between the compliance of the pressure chamber 52 and the inertance of the supply side flow passage, including the nozzle 51 and the supply port 54, and thus obtains a predetermined ejection frequency.

When ejecting high-viscosity ink having a higher viscosity than typical ink, this resonance rapidly attenuates, and hence a high resonance frequency is required to perform a pull-push ejection before the resonance attenuates.

When highly viscous ink is used, the pressure that is applied to the ink during ejection is sometimes increased to obtain stable ejection. When the pressure applied to the ink during ejection is increased, the amount of volume change in the pressure chamber 52 rises, and hence the size of the ejected ink droplet increases. It is therefore impossible to reduce the size of the ejected ink droplet in cases where only the ejection pressure must be increased.

The ink chamber unit 53 of the present embodiment is structured to be able to obtain a predetermined ejection frequency even when highly viscous ink is used. When the actuator 58 is driven in the ejection direction, the amount of ink that is drained into the common flow passage 55 through the supply port 54 is set to be larger than the amount of ink that is ejected through the nozzle 51, so that a small ink droplet can be ejected even when highly viscous ink is used.

Here, to cite an example of the shape of a print head (inkjet head) in a typical inkjet recording apparatus, the pressure chamber 52 has a length of 700 μm, a width of 700 μm, and a height of 150 μm, the nozzle has a diameter of 30 μm and a conduit length of 40 μm, the supply port has a square cross-section of 40 μm×40 μm, and a flow passage length of 100 μm. For ease of description here, the nozzle is structured such that the broad-conduit portion 51C and the nozzle narrow-conduit portion 51B have the same diameter and the same flow passage length.

Assuming that driving is commenced at a time 0 when the ink in the nozzle 51 is static (no vibration) due to the viscosity of the ink, a time period Td extends from the driving to the point at which the amplitude attenuates by 1/c when another driving is not applied, and half of the resonance period (the pull-push ejection time interval at which the effects of pull-push ejection are greatest) is Tm, then it is effective to perform pull-push ejection when the condition Td>Tm is satisfied.

In a typical ink chamber unit having the shape described above, this relationship is established (the effects of pull-push ejection can be obtained) when the viscosity of the ink is notmorethan 18 cP ($1.8\times10^{-2}$ Pa·s).

In other words, when the ink viscosity exceeds 18 cP, it is difficult to obtain the effects of pull-push ejection in an ink chamber unit having the shape described above.

In the ink recording apparatus 10, the shape of the ink chamber unit 53 is fixed such that the effects of pull-push ejection are obtained even when highly viscous ink having a viscosity between 20 cP and 50 cP is used. Moreover, in the ink recording apparatus 10, the effects of pull-push ejection are exhibited to the maximum extent when the ink viscosity is between 20 cP and 30 cP.

Figure 8:
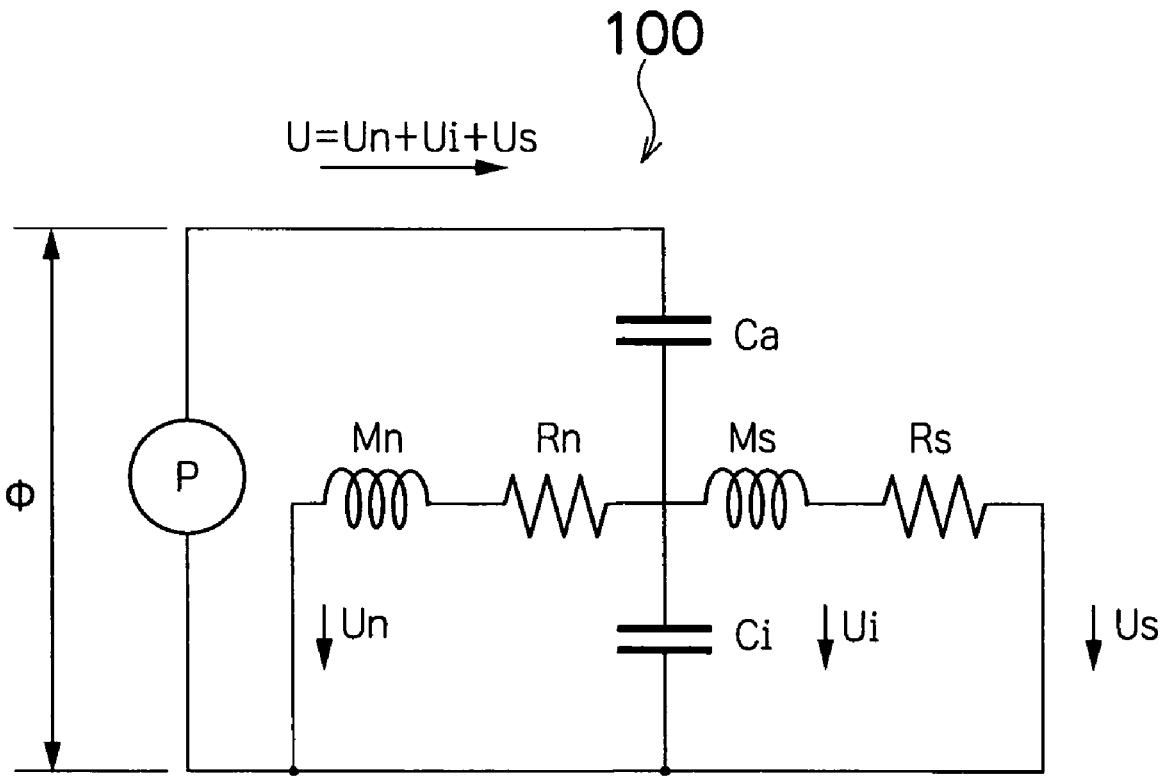
FIG. 8 is a view showing a lumped-constant model of the print head shown in FIGS. 3A to 3C.

FIG. 8 shows a lumped-constant model (lumped-constant circuit) 100 for representing the functions (features) of the ink chamber unit 53 shown in FIG. 4 with an electric circuit.

In the lumped-constant model 100 shown in FIG. 8, $M_n$ represents inertance of the nozzle 51, $R_n$ represents liquid resistance of the nozzle 51, $M_s$ represents inertance of the supply port 54, $R_s$ represents liquid resistance of the supply port 54, $C_i$ represents the compliance of the pressure chamber 52, $C_a$ represents the compliance of the actuator 58, and Φ represents a pressure difference. Moreover, $u_n$ represents the volume velocity of the ink in the nozzle 51, $u_i$ represents the volume velocity of the ink in the pressure chamber 52, and $u_s$ represents the volume velocity of the ink in the supply port 54.

The differential equation of the lumped-constant model 100 is expressed by the following simultaneous equations (1) to (3):

$$\Phi = \frac{1}{C_a}\int(u_n + u_i + u_s)dt + \frac{1}{C_i}\int u_i dt; \tag{1}$$

$$\frac{1}{C_i}\int u_i dt = R_n \cdot u_n + M_n\frac{du_n}{dt}; \text{ and} \tag{2}$$

$$\frac{1}{C_i}\int u_i dt = R_s \cdot u_s + M_s\frac{du_s}{dt}. \tag{3}$$

Here, the inertance $M_n$ of the nozzle 51, the resistance $R_n$ of the nozzle 51, the compliance $C_n$ caused by the surface tension of the ink at the nozzle 51, the inertance $M_s$ of the supply port 54, the resistance $R_s$ of the supply port 54, the compliance $C_i$ of the pressure chamber 52, the compliance $C_a$ of the actuator 58 are expressed as follows:

$$M_n = \rho\cdot\left(\frac{L_{n1}}{A_{n1}} + \frac{L_{n2}}{A_{n2}}\right); \tag{4}$$

$$R_n = 8\cdot\pi\cdot\nu\cdot\left(\frac{L_{n1}}{A_{n1}^2} + \frac{L_{n2}}{A_{n2}^2}\right); \tag{5}$$

$$C_n = \frac{\pi\cdot r_{n2}^4}{3\cdot\sigma}; \tag{6}$$

$$M_s = \rho\cdot\frac{L_s}{A_s}; \tag{7}$$

$$R_s = 8\cdot\pi\cdot\nu\cdot\frac{L_s}{A_s^2}; \tag{8}$$

$$C_i = \frac{V}{\rho\cdot c^2}; \text{ and} \tag{9}$$

$$C_a = \frac{X}{P}, \tag{10}$$

where ρ is the ink density, ν is the ink viscosity, σ is the surface tension of the ink, $L_{n1}$ is the flow passage length of the nozzle broad-conduit portion 51C, $A_{n1}$ is the sectional area of the nozzle broad-conduit portion 51C, $r_{n1}$ is the radius of the nozzle broad-conduit portion 51C (=$D_{n1}/2$), $L_{n2}$ is the flow passage length of the nozzle narrow-conduit portion 51B, $A_{n2}$ is the sectional area of the nozzle narrow-conduit portion 51B, $r_{n2}$ is the radius of the nozzle narrow-conduit portion 51B (=$D_{n2}/2$), $L_s$ is the length of the supply port 54, $A_s$ is the sectional area of the supply port 54, V is the volume of the pressure chamber 52, c is the sonic speed in the ink, and P is the pressure generated by the actuator 58 to produce the excluded volume X, which is the sum of the volume of ink ejected to the outside through the nozzle 51, the volume of ink that returns to the supply side, and the volume of ink that is compressed upon the application of the pressure P.

The compliance $C_n$ caused by the surface tension of the ink at the nozzle 51 shown in the equation (6) is the sum of the capacitive component of the inertance of the nozzle 51 and the capacitive component of the resistance of the nozzle 51. However, the effects of these components are negligible in the system shown in the lumped-constant model 100 in FIG. 8, and therefore $C_n$ is not shown on the lumped-constant model 100 in FIG. 8.

As shown in the equation (4), when calculating the inertance of a flow passage constituted by a plurality of flow passages, the combined inertance can be determined after determining the inertance of each flow passage. Likewise, when calculating the resistance and compliance of a flow passage constituted by a plurality of flow passages, the resistance and compliance may be calculated for each flow passage and then combined.

The resonance frequency f between the compliance of the pressure chamber 52 and the inertance of the nozzle 51 is determined by solving the simultaneous differential equations (1) to (3) of the lumped-constant model 100, and is expressed using the above equations (4) to (10), as follows:

$$f = \frac{\sqrt{\frac{1}{M\cdot C} - \frac{R^2}{M^2}}}{2\cdot\pi}, \tag{11}$$

where $$M = \frac{M_n\cdot M_s}{M_n + M_s}; \tag{12}$$

$$R = \frac{1}{\frac{1}{R_n} + \frac{1}{R_s}}; \text{ and} \tag{13}$$

$$C = C_i + C_a. \tag{14}$$

Hence, in order to raise the resonance frequency f shown in the equation (11), it is effective to reduce the inertance M shown in the equations (12) and (13). However, as described with reference to the related art, it is extremely difficult to reduce the inertance $M_n$ of the nozzle 51 and the compliance C shown in the equation (14). Therefore, in the print head 50 according to the present embodiment, the resonance frequency f is increased by reducing the inertance $M_s$ of the supply port 54, and favorable ejection of highly viscous ink is realized by driving the actuator 58 with a pull-push-out operation.

According to the equation (7), in order to reduce the inertance $M_s$ of the supply port 54, it is effective to increase the sectional area of the supply port 54, and/or to reduce the flow passage length of the supply port 54.

Figure 9:
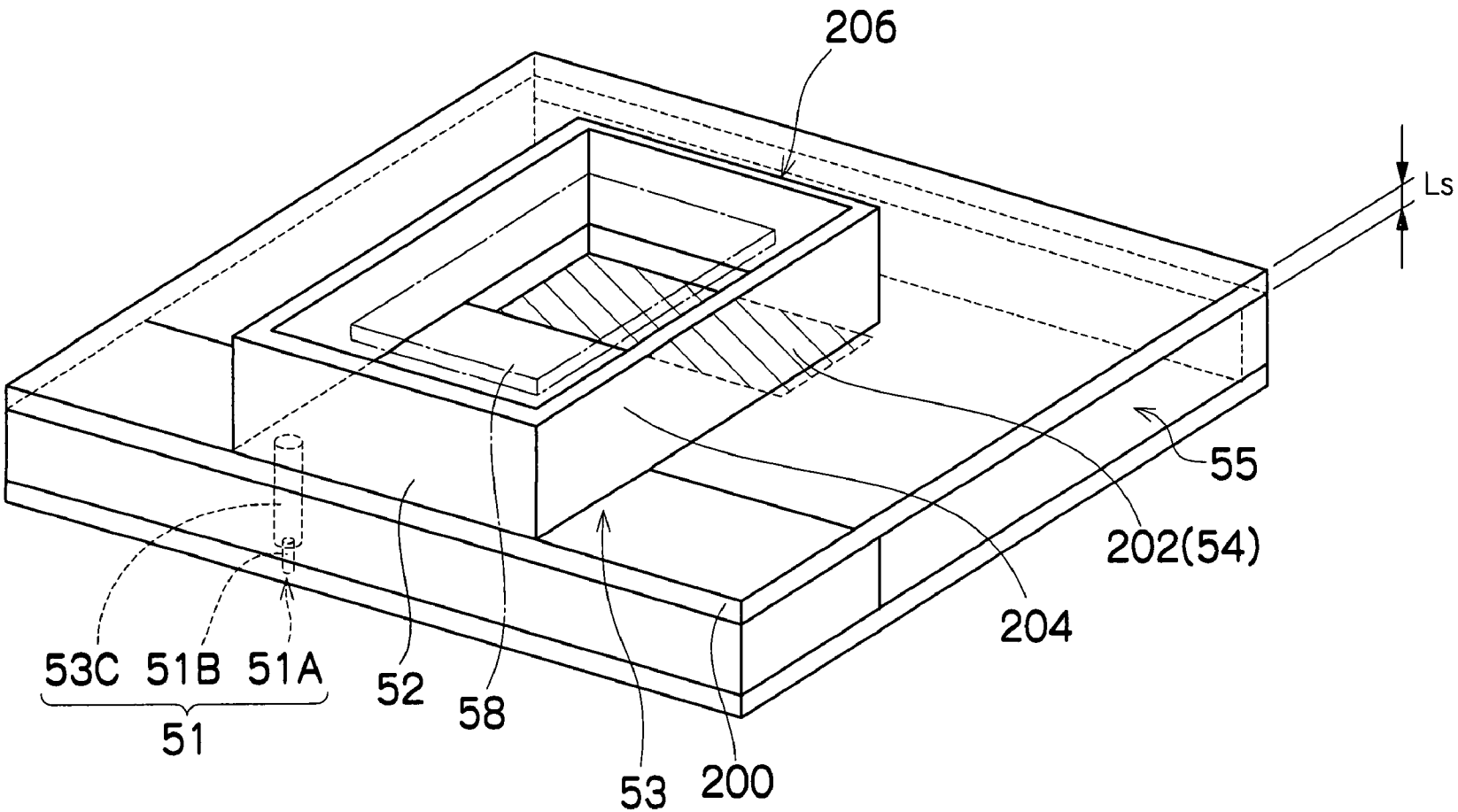
FIG. 9 is a projected perspective view showing the structure of an ink chamber unit shown in FIG. 4.

FIG. 9 is a projected perspective view showing the structure of the ink chamber unit 53 shown in sectional form in FIG. 4. The ink chamber unit 53 shown in FIG. 9 is one of the large number of ink chamber units provided in the print head 50.

As shown in FIG. 9, the supply port 54 is constituted by a substantially rectangular opening 202 formed in a supply port plate 200, and the sectional area $A_s$ thereof is substantially equal to ½ of a bottom face 204 of the pressure chamber 52. The flow passage length $L_s$ of the supply port 54 is equal to the thickness of the supply port plate 200.

The supply port 54 is structured in the present embodiment such that the sectional form on the plane substantially orthogonal to the ink flow direction is substantially rectangular; however, the sectional form is not limited to a substantially rectangular form, and various forms, such as a circle, an ellipse, or a polygonal form other than a quadrilateral form, can be applied.

Moreover, the supply port 54 is provided in the present embodiment in the bottom face 204 of the pressure chamber 52 (the plane in which the opening communicating with the nozzle 51 is formed); however, the supply port 54 can be provided in a side face of the pressure chamber 52 (e.g., the side face 206). The actuator 58 shown in FIG. 4 is described with the alternate long and short dash lines in FIG. 9.

Figure 10:
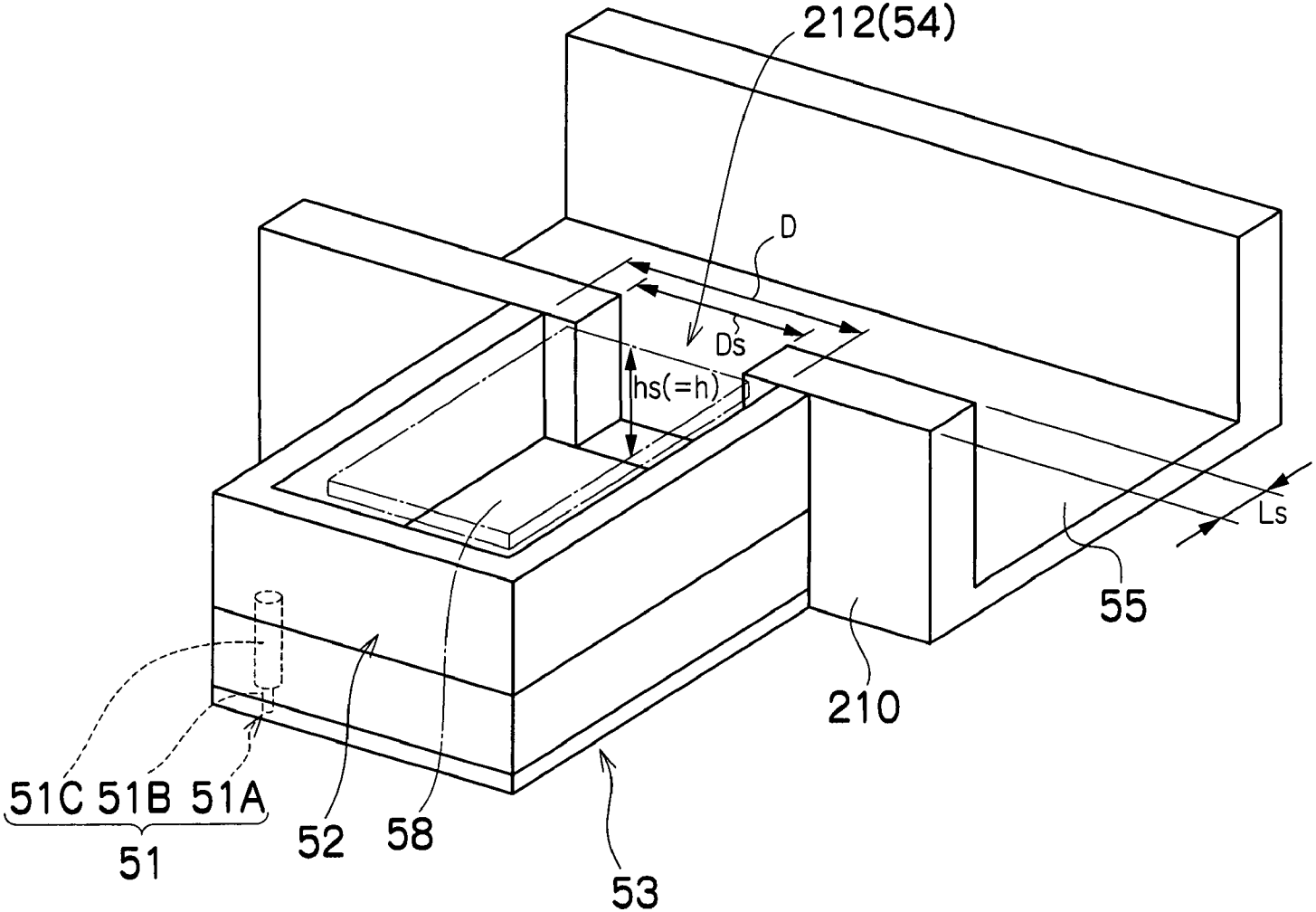
FIG. 10 is a projected perspective view showing another aspect of the ink chamber unit shown in FIG. 9.
Figure 11:
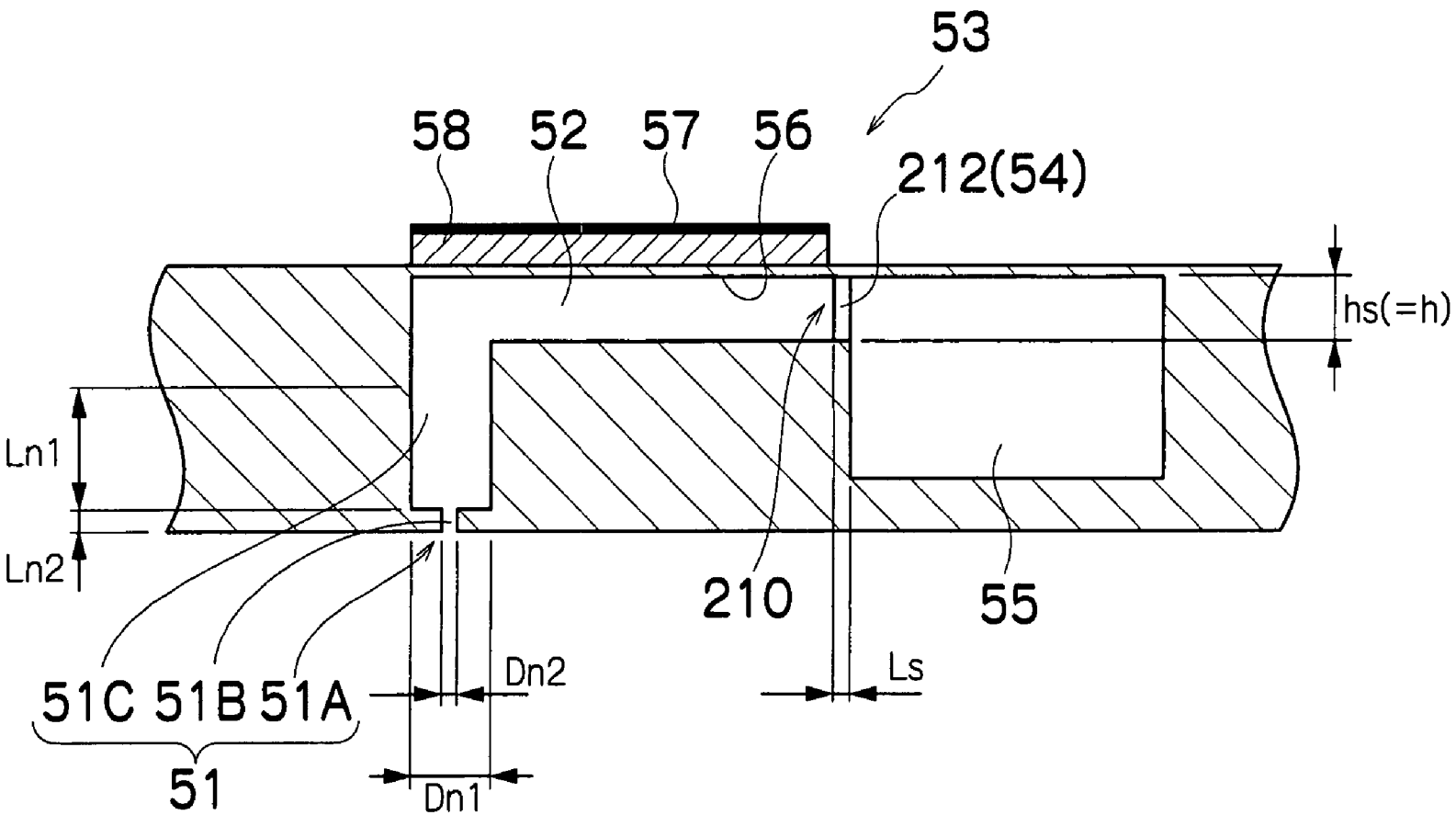
FIG. 11 is a sectional view showing the solid structure of the ink chamber unit shown in FIG. 10.

FIGS. 10 and 11 show an aspect in which the supply port (54) is provided on the side face of the pressure chamber 52. FIG. 10 is a perspective view showing the solid structure of the ink chamber unit 53 and the disposal relationship between the pressure chamber 52 and the common flow passage 55, and also a projected view seen from the ceiling face (the pressure plate 56) side of the pressure chamber 52. FIG. 10 shows a state in which the member forming the ceiling face of the pressure chamber 52 and the member forming the ceiling face of the common flow passage 55 have been removed. The actuator 58 is described with the alternate long and short dash lines in FIG. 10.

FIG. 11 is a sectional view showing the cross-sectional structure of FIG. 10 and corresponds to FIG. 4.

In the aspect shown in FIGS. 10 and 11, the side face 206 of the pressure chamber 52 shown in FIG. 9 is removed, and the face from which this side wall has been removed is joined to a side wall 210 on the pressure chamber side of the common flow passage 55. In other words, the face corresponding to the side face 206 of the pressure chamber 52 shown in FIG. 9 serves as a joint face with the common flow passage 55.

A cut-away portion 212 is provided in the pressure chamber-side side wall 210 of the common flow passage 55 at the part that is joined to the pressure chamber 52. The pressure chamber 52 and the common flow passage 55 communicate with each other through the cut-away portion 212. In other words, the cut-away portion 212 provided in the side wall 210 of the common flow passage 55 functions as the supply port (54) of the ink chamber unit 53.

As shown in FIG. 10, the width of the cut-away portion 212 functioning as the supply port corresponds to a length $D_s$ of one side in the width direction of the supply port 54 shown in FIG. 4. The width $D_s$ of the cut-away portion 212 is illustrated as being smaller than a width D of the part of the pressure chamber 52 that is joined to the common flow passage 55; however, in order to reduce the inertance $M_n$ of the supply port (i.e., the cut-away portion 212), it is preferable to increase the width $D_s$ of the cut-away portion 212. In other words, the cut-away portion 212 preferably has a substantially identical size and a substantially identical shape to the face of the pressure chamber 52 that is joined to the common flow passage 55 (i.e., it is preferable that the relationships of $D_s$=D and $h_s$=h are satisfied, where $h_s$ is the height of the cut-away portion 212 and h is the height of the pressure chamber 52).

In order to reduce the inertance Ms of the supply port 54, it is also preferable to reduce the flow passage length $L_s$ of the supply port 54, as shown in the above equation (7). In order to reduce the flow passage length $L_s$ of the supply port 54, it is preferable to reduce the thickness of the supply port plate 200 in the aspect shown in FIG. 9, and to reduce the thickness of the cut-away portion 212 (the part joined to the pressure chamber 52) in the side wall 210 of the common flow passage 55 in the aspect shown in FIG. 10.

In the aspect shown in FIG. 9, the supply port plate 200 serves as the bottom face of the pressure chamber 52. Accordingly, the supply port plate 200 requires sufficient rigidity to be able to function as the bottom face of the pressure chamber 52, and therefore can only be reduced in thickness to a certain degree. In the aspect shown in FIGS. 10 and 11, on the other hand, the flow passage length $L_s$ of the supply port 54 can be reduced by reducing the thickness of the side wall 210, and therefore the flow passage length $L_s$ of the supply port 54 can be reduced to zero.

Figure 12:
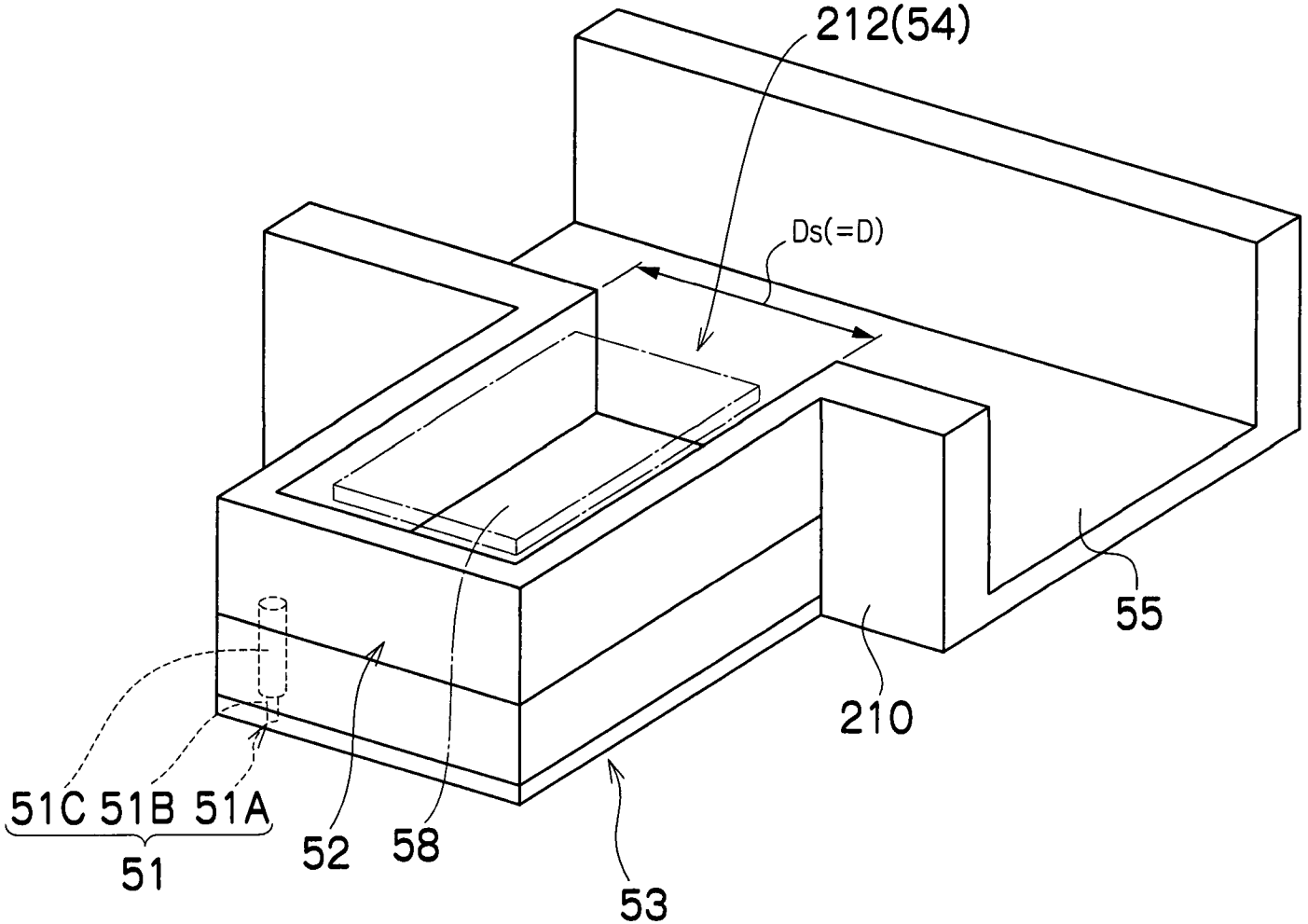
FIG. 12 is a projected perspective view showing another aspect of the ink chamber unit shown in FIG. 9.

FIG. 12 shows an aspect in which the pressure chamber 52 is joined directly to the common flow passage 55, and the thickness of the cut-away portion 212 is reduced to zero. In the aspect shown in FIG. 12, the sectional area $A_s$ of the supply port is at a maximum, and the flow passage length $L_s$ of the supply port is at a minimum, and hence this aspect is even more preferable.

Here, the supply port described with reference to the present embodiments indicates a part or all of the supply side flow passage from the joint part with the pressure chamber 52 to the part functioning as the restrictor during an ink ejection operation and a refill operation, rather than merely the ink flow passage linking the pressure chamber 52 and the common flow passage 55 (including the branches dividing from the common flow passage).

Figure 13:
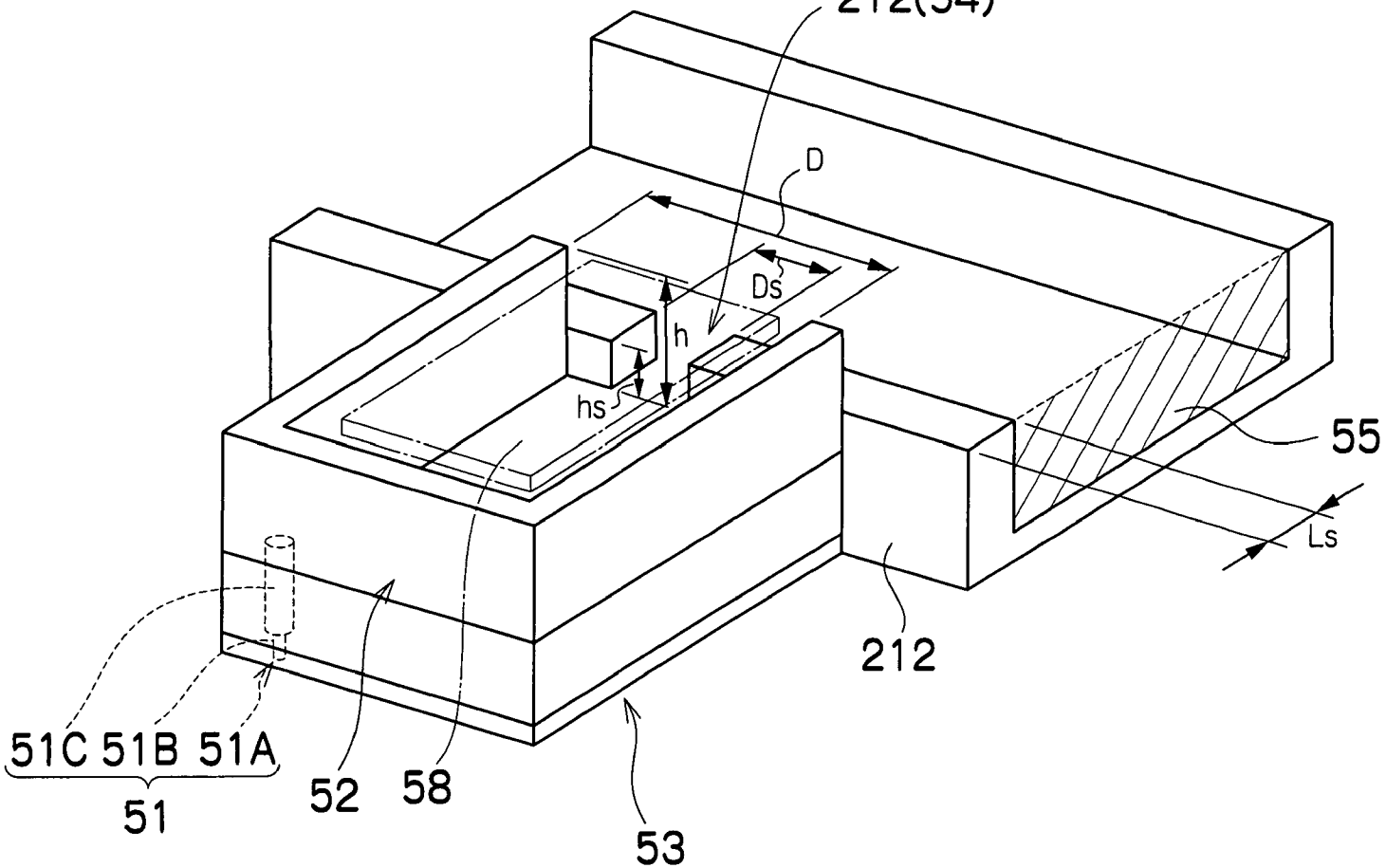
FIG. 13 is a projected perspective view showing another aspect of the ink chamber unit shown in FIG. 9.

In the aspect shown in FIG. 13, for example, when the relationship between the sectional area $A_s$ of the supply port 54 ($=D_s \times h_s$) and the sectional area A of the common flow passage 55 (the sectional area of the part shown with the hatching in FIG. 13) satisfies $A_s > A$, the common flow passage 55 functions as the restrictor.

The nozzle described with reference to the present embodiments includes the ejection side flow passage from the joint part with the pressure chamber 52 to the part functioning as the restrictor.

Figure 14:
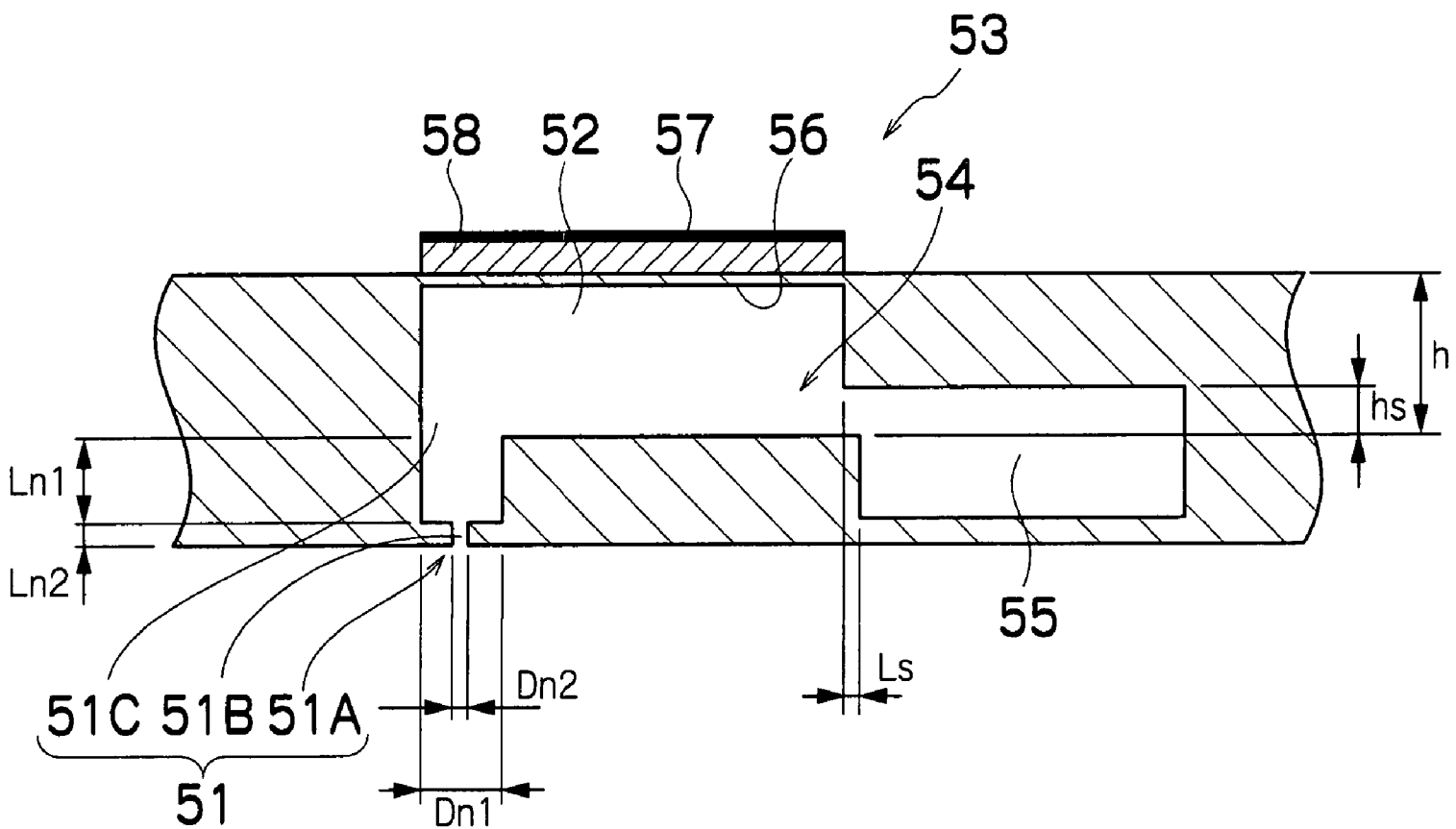
FIG. 14 is a sectional view showing the solid structure of the ink chamber unit shown in FIG. 13.

The height $h_s$ of the supply port 54 and the height h of the pressure chamber 52 are shown to be substantially equal (i.e., $h_s$=h) in the aspects shown in FIGS. 10 through 12; however, the height $h_s$ of the supply port 54 and the height h of the pressure chamber 52 can be different from each other (i.e., $h_s$<h), as shown in FIGS. 13 and 14.

APPLICATION EXAMPLES

Next, application examples of the ink chamber unit 53 provided in the print head 50 will be described.

Figure 15:
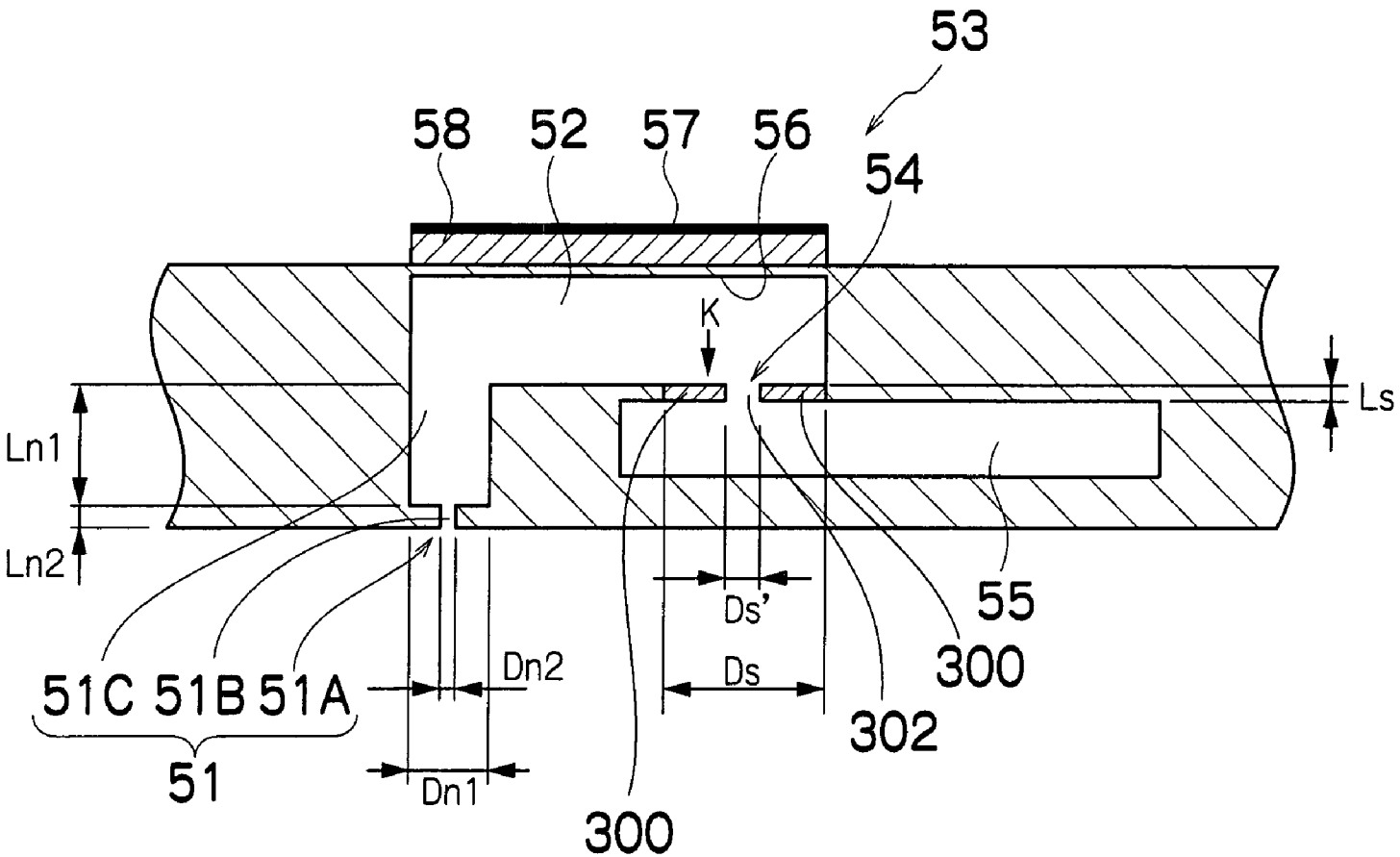
FIG. 15 is a sectional view showing the solid structure of an application example of the ink chamber unit shown in FIG. 9.

FIG. 15 is a sectional view showing the solid structure of the ink chamber unit 53 in an application example of the present embodiment.

As shown in FIG. 15, an elastic member 300 is provided at the supply port 54. The elastic member 300 has a substantially identical size to the supply port 54, and is provided with an opening (hole) 302 in the substantially central portion thereof. A diameter Ds' of the opening 302 is considerably smaller than the width Ds of the supply port 54. Cuttings extending radially from the opening 302 are provided in the elastic member 300 so that the sectional area of the opening 302 increases when pressure is applied.

The elastic member 300 has an anistropic property so that the elastic member 300 deforms toward the common flow passage 55 side when pressure is applied in the direction denoted with an arrow K, but does not deform when pressure is applied in the direction opposite to the direction of the arrow K (or deforms less than when pressure is applied in the direction of the arrow K).

More specifically, when the actuator 58 is driven to deform the pressure chamber 52 in a direction that enables ink to be ejected from the pressure chamber 52, the elastic member 300 is applied with the pressure in the direction of the arrow K, and thereby deforms toward the common flow passage 55 side such that ink is drained into the common flow passage 55 through the supply port 54, the width of which is substantially $D_s$.

Conversely, when the pressure chamber 52 is deformed in a direction to draw ink into the pressure chamber 52, the elastic member 300 does not deform, and hence ink is supplied to the pressure chamber 52 from the common flow passage 55 through the opening 302 provided in the elastic member 300.

In other words, the sectional area of the supply port 54 can be switched (varied) between ink ejection periods and ink refilling periods. The sectional area of the supply port 54 is incleased to $A_s'$ during ejection to maintain a favorable ejection performance, while the sectional area of the supply port 54 is kept to $A_s$ during refilling to prevent air bubbles or foreign matter from becoming mixed into the pressure chamber 52. The elastic member 300 can be made from a material such as rubber or silicone.

In the print head 50 constituted as described above, the sectional area $A_s$ of the supply port 54 (supply side flow passage) and the flow passage length $L_s$ of the supply port 54 (supply side flow passage) are determined such that the inertance (ejection side inertance) $M_n$ of the nozzle 51 and the inertance (supply side inertance) $M_s$ of the supply port 54 have a relationship of $M_n>M_s$. In so doing, favorable ink droplet ejection can be realized by performing a pull ejection, using the resonance between the compliance of the pressure chamber 52 and the inertance of the nozzle 51, even when highly viscous ink having a higher viscosity than typical ink is used.

During this ejection operation, minute ink droplets can be ejected in a short ejection cycle, and moreover, since the inertance $M_s$ of the supply side flow passage and the resistance $R_s$ of the supply side flow passage are reduced, the time required for refilling can be shortened, enabling an improvement in the ejection efficiency.

Further, according to the aspect shown in FIG. 12, the supply port 54 can be eliminated by reducing the flow passage length of the supply port 54 to zero. As a result, the structure of the print head 50 is made simpler, and in the case of a print head having a laminated structure in which a plurality of thin plate members are laminated, the layer forming the supply port 54 can be omitted, leading to a reduction in the number of layers.

The common flow passage 55 is formed on the opposite side of the actuator 58 (the lower side in FIG. 4 etc.) in the above-described embodiments; however, it is also possible to form the common flow passage 55 on the side of the actuator 58 (the upper side of FIG. 4 etc.).

The pressure chamber 52 is disposed in a direction substantially orthogonal to the lengthwise direction of the common flow passage 55 (the ink flow direction) in the above-described embodiments; however, it is also possible to dispose the pressure chamber 52 in the lengthwise direction of the common flow passage.

The inkjet recording apparatus described above is an example of a liquid ejection apparatus, and the scope of application of the present invention is not limited to this example. The present invention can be applied to various image forming apparatuses and liquid ejection apparatuses which form solid forms on an ejection receiving medium by depositing liquid onto the ejection receiving medium.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a nozzle through which liquid is ejected, the nozzle having an inertance Mn;

a pressure chamber which accommodates the liquid to be ejected through the nozzle;

a pressurizing device which applies pressure to the liquid accommodated in the pressure chamber by deforming the pressure chamber to eject the ink from the pressure chamber;

a supply side flow passage which communicates with the pressure chamber and supplies the liquid to the pressure chamber, and the supply side flow passage having an inertance Ms smaller than the inertance Mn of the nozzle; and a restricting device which varies the minimum sectional area of the supply side flow passage so that the minimum sectional area As of the supply side flow passage when the liquid is supplied from the supply side flow passage into the pressure chamber and the minimum sectional area As' of the supply side flow passage when the liquid is drained into the supply side flow passage from the pressure chamber have a relationship of As<As'.

2. The liquid ejection head as defined in claim 1, wherein a sectional area A of the supply side flow passage at a joint face wit the pressure chamber and a minimum sectional area As of the supply side flow passage have a relationship of A>As.

3. The liquid ejection head as defined in claim 1, wherein the restricting device comprises an elastic member including an opening portion having an opening area smaller than the minimum sectional area As of the supply side flow passage.

4. The liquid ejection head as defined in claim 1, wherein a sectional area A of the supply side flow passage at a joint face with the pressure chamber and a minimum sectional area As of the supply side flow passage have a relationship of A=As.

5. The liquid ejection head as defined in claim 1, wherein a minimum sectional area An of the nozzle and a minimum sectional area As of the supply side flow passage have a relationship of An<As.

6. The liquid ejection head as defined in claim 5, wherein a sectional area A of the supply side flow passage at a joint face with the pressure chamber and the minimum sectional area As of the supply side flow passage have a relationship of A>As.

7. The liquid ejection head as defined in claim 5, wherein a sectional area A of the supply side flow passage at a joint face with the pressure chamber and the minimum sectional area As of the supply side flow passage have a relationship of A=As.

8. The liquid ejection head as defined in claim 1, wherein the pressurizing device comprises a piezoelectric element.

9. A liquid ejection apparatus, comprising: an ejection head which ejects droplets of liquid onto an ejection receiving medium, wherein the ejection head includes the liquid ejection head as defined in claim 1.

* * * * *